US011697863B2

(12) United States Patent
Osako

(10) Patent No.: US 11,697,863 B2
(45) Date of Patent: Jul. 11, 2023

(54) SPHERICAL SILVER POWDER AND METHOD FOR PRODUCING SAME

(71) Applicant: Dowa Electronics Materials Co., Ltd, Tokyo (JP)

(72) Inventor: Masaya Osako, Tokyo (JP)

(73) Assignee: DOWA ELECTRONICS MATERIALS CO., LTD., Tokyo (JP)

( * ) Notice: Subject to any disclaimer, the term of this patent is extended or adjusted under 35 U.S.C. 154(b) by 36 days.

(21) Appl. No.: 16/772,892

(22) PCT Filed: Dec. 13, 2018

(86) PCT No.: PCT/JP2018/045812
§ 371 (c)(1),
(2) Date: Jun. 15, 2020

(87) PCT Pub. No.: WO2019/117235
PCT Pub. Date: Jun. 20, 2019

(65) Prior Publication Data

US 2021/0162501 A1 Jun. 3, 2021

(30) Foreign Application Priority Data

Dec. 15, 2017 (JP) ..... 2017-240248
Dec. 12, 2018 (JP) ..... 2018-232210

(51) Int. Cl.
*B22F 1/05* (2022.01)
*B22F 9/24* (2006.01)
*B22F 1/065* (2022.01)

(52) U.S. Cl.
CPC ..... *B22F 9/24* (2013.01); *B22F 1/05* (2022.01); *B22F 1/065* (2022.01);
(Continued)

(58) Field of Classification Search
None
See application file for complete search history.

(56) References Cited

U.S. PATENT DOCUMENTS

2018/0235232 A1* 8/2018 Moeller ..... A61K 8/044

FOREIGN PATENT DOCUMENTS

CN 102585743 A * 7/2012
CN 104987672 A * 10/2015
(Continued)

OTHER PUBLICATIONS

English Translation of CN-102585743-A (originally published Jul. 18, 2012) from Espacenet.*
(Continued)

*Primary Examiner* — George Wyszomierski
(74) *Attorney, Agent, or Firm* — Bachman & LaPointe, P.C.

(57) ABSTRACT

There are provided a spherical silver powder which has the same diameter as that of a spherical silver powder produced by a conventional wet reduction method and which can sufficiently sinter the silver particles thereof to cause the silver particles to be adhered to each other at a relatively low temperature to form a conductive film having a low volume resistivity when it is used for a baked type conductive paste, and a method for producing the same. A spherical silver powder, which contains a neutral or basic amino acid having a carbon number of not less than 5 in each of particles thereof and which has an average particle diameter $D_{50}$ of 0.2 to 5 μm based on a laser diffraction method, is produced by adding the neutral or basic amino acid having the carbon number of not less than 5 (such as proline, tyrosine, tryptophan, phenylalanine, arginine or histidine) to a water reaction system containing silver ions to mix a reducing agent therewith to deposit silver particles by reduction.

5 Claims, 7 Drawing Sheets

(52) U.S. Cl.
CPC ... *B22F 2009/245* (2013.01); *B22F 2301/255* (2013.01); *B22F 2304/056* (2013.01); *B22F 2304/058* (2013.01); *B22F 2998/10* (2013.01); *B22F 2999/00* (2013.01)

(56) References Cited

FOREIGN PATENT DOCUMENTS

| | | | |
|---|---|---|---|
| CN | 105618783 | A | 6/2016 |
| JP | 08176620 | A | 7/1996 |
| JP | 2008255270 | A | 10/2008 |
| JP | 2008255370 | A | 10/2008 |
| JP | 2011021252 | A | 2/2011 |
| JP | 2012214873 | A | 11/2012 |
| JP | 2016054098 | A | 4/2016 |

OTHER PUBLICATIONS

English Translation of CN-104987672-A (originally published Oct. 21, 2015) from Espacenet.*
Leilei Kang et al., "Amino Acid-Assisted Synthesis of Hierarchical Silver Microspheres for Single Particle Surface-Enhanced Raman Spectroscopy", The Journal of Physical Chemistry, 2013, vol. 117, 10007-10012.
Supplementary European search report for patent application No. 18 88 8028 dated Jun. 28, 2021.
International search report for patent application No. PCT/JP2018/045808 dated Feb. 5, 2019.

* cited by examiner

SPHERICAL SILVER POWDER AND METHOD FOR PRODUCING SAME

TECHNICAL FIELD

The present invention relates generally to a spherical silver powder and a method for producing the same. More specifically, the invention relates to a spherical silver powder (for conductive paste) which can be suitably used for a conductive paste for forming electrodes and circuits of electronic parts, such as substrates for solar cells and touch panels, and so forth, and a method for producing the same.

BACKGROUND ART

As a conventional method for forming electrodes and circuits of electronic parts and so forth, there is widely used a method for forming a conductive film, the method comprising the steps of: adding a silver powder and a glass frit in an organic vehicle to knead them to prepare a baked type conductive paste; forming the conductive paste in a predetermined pattern on a substrate; and heating the formed conductive paste at a temperature of not less than 500° C. to remove organic components to sinter silver particles to cause the silver particles to be adhered to each other.

The silver powder for conductive paste for use in such a method is required to have a reasonably small particle size and a reasonably narrow range of the particle size in order to form conductive patterns having a high density and fine lines to miniaturize electronic parts and/or in order to form figure electrodes having fine lines to increase the light-gathering area of solar cells to improve the power generation efficiency thereof. It is also desired to provide a silver powder which can be suitably used for a conductive paste capable of forming conductive patterns, electrodes and so forth, which can efficiently flow current, even if the conductive patterns and electrodes have a small cross-sectional area due to the fine lines. For that reason, it is desired to provide a silver powder wherein the silver particles thereof can be sintered to be adhered to each other even if it is heated at a lower temperature.

As a method for producing a silver powder for such a conductive paste, there is known a wet reduction method for depositing a spherical silver powder by reduction by adding a reducing agent to a water reaction system containing silver ions (see, e.g., Patent Document 1).

Prior Art Document(s)

Patent Document(s)

Patent Document 1: JP H08-176620A (Paragraph Numbers 0008-0013)

SUMMARY OF THE INVENTION

Problem to be Solved by the Invention

However, if a spherical silver powder having the same diameter as that of a spherical silver powder produced by the conventional wet reduction method is used for a baked type conductive paste, there is some possibility that it is not possible to sufficiently sinter the silver particles of the silver powder to cause the silver particles to be adhered to each other at a relatively low temperature, so that it is not possible to form a conductive film having a low volume resistivity.

It is therefore an object of the present invention to eliminate the aforementioned problems and to provide a spherical silver powder which has the same diameter as that of a spherical silver powder produced by a conventional wet reduction method and which can sufficiently sinter the silver particles thereof to cause the silver particles to be adhered to each other at a relatively low temperature to form a conductive film having a low volume resistivity when it is used for a baked type conductive paste, and a method for producing the same.

Means for Solving the Problem

In order to accomplish the aforementioned object, the inventors have diligently studied and found that it is possible to produce a spherical silver powder which has the same diameter as that of a spherical silver powder produced by a conventional wet reduction method and which can sufficiently sinter the silver particles thereof to cause the silver particles to be adhered to each other at a relatively low temperature to form a conductive film having a low volume resistivity when it is used for a baked type conductive paste, if an amino acid, which has a carbon number of not less than 5 and which is neutral or basic, is added to a water reaction system containing silver ions to add a reducing agent thereto to deposit silver particles by reduction. Thus, the inventors have made the present invention.

According to the present invention, there is provided a method for producing a spherical silver powder, the method comprising the steps of: preparing a water reaction system containing silver ions; preparing an amino acid which has a carbon number of not less than 5 and which is neutral or basic; and adding the amino acid to the water reaction system, and thereafter, adding a reducing agent to the water reaction system to deposit silver particles by reduction.

In this method for producing a spherical silver powder, the amino acid is preferably an alpha-amino acid, and is preferably at least one selected from the group consisting of proline, tyrosine, tryptophan, phenylalanine, arginine, histidine and anthranilic acid. After the silver particles are deposited by reduction, a surface treatment agent is preferably added. The amount of the amino acid to be added is preferably 0.05 to 6% by weight with respect to silver in the water reaction system.

According to the present invention, there is provided a spherical silver powder which comprises: spherical silver particles; and an amino acid which has a carbon number of not less than 5 and which is neutral or basic, the amino acid being contained in each of the spherical silver particles, wherein the spherical silver powder has an average particle diameter $D_{50}$ of 0.2 to 5 μm based on a laser diffraction method.

In this spherical silver powder, the amino acid is preferably an alpha-amino acid, and is preferably at least one selected from the group consisting of proline, tyrosine, tryptophan, phenylalanine, arginine, histidine and anthranilic acid. The amount of the amino acid contained in each of the spherical silver particles is preferably in the range of from 0.00001% by weight to 1% by weight. The BET specific surface area of the spherical silver powder is preferably in the range of from 0.1 $m^2/g$ to 3 $m^2/g$.

Throughout the specification, the expression "average particle diameter $D_{50}$ based on a laser diffraction method" means a particle diameter ($D_{50}$) corresponding to 50% of accumulation in volume-based cumulative distribution of the spherical silver powder, which is measured by means of a laser diffraction particle size analyzer.

Effects of the Invention

According to the present invention, it is possible to produce a spherical silver powder which has the same diameter as that of a spherical silver powder produced by a conventional wet reduction method and which can sufficiently sinter the silver particles thereof to cause the silver particles to be adhered to each other at a relatively low temperature to form a conductive film having a low volume resistivity when it is used for a baked type conductive paste.

MODE FOR CARRYING OUT THE INVENTION

Figure 1:
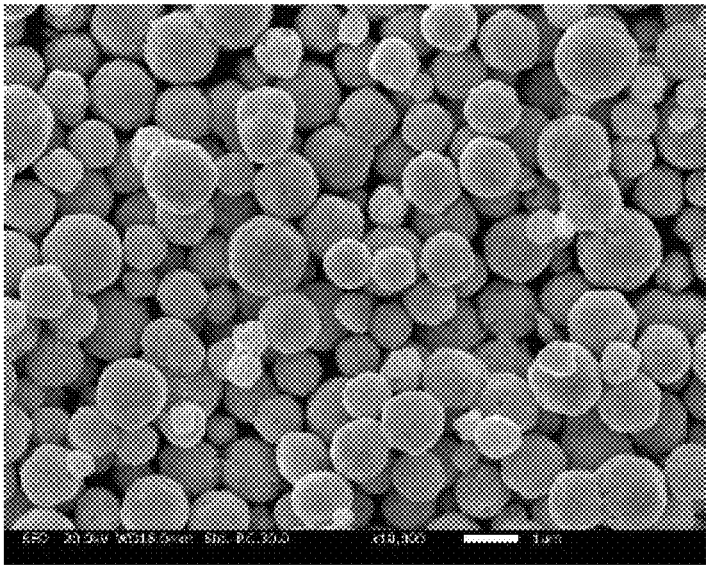
FIG. 1 is a scanning electron microscope (SEM) image of a spherical silver powder which is obtained in Example 2.

In the preferred embodiment of a method for producing a spherical silver powder according to the present invention, a neutral or basic amino acid having a carbon number of not less than 5 (preferably not less than 6) is added to a water reaction system containing silver ions, and then, a reducing agent is mixed therewith to deposit silver particles by reduction.

As the water reaction system containing silver ions, an aqueous solution or slurry containing silver nitrate, a silver complex or a silver intermediate may be used. The aqueous solution containing the silver complex may be produced by adding aqueous ammonia or an ammonia salt to an aqueous silver nitrate solution or a suspension of silver oxide. Among them, an aqueous solution of silver ammine complex obtained by adding aqueous ammonia to an aqueous silver nitrate solution is preferably used in order to produce a silver powder having an appropriate particle size and a spherical shape. The coordination number of ammonia in the silver ammine complex is 2, so that 2 moles or more of ammonia per 1 mole of silver is added. If the amount of ammonia to be added is too large, the complex is too stable, so that it is difficult to proceed reduction. Therefore, the amount of ammonia to be added is preferably not larger than 8 moles per 1 mole of silver. If there is carried out an adjustment, such as the increase of the amount of ammonia to be added, even if the amount of ammonia to be added exceeds 8 moles, it is possible to obtain a silver powder having an appropriate particle size. Furthermore, the water reaction system containing silver ions is preferably alkaline, and is preferably adjusted to be alkaline by adding an alkali, such as sodium hydroxide, as a pH adjuster thereto.

The amino acid to be added is a neutral or basic amino acid having the carbon number of not less than 5 (preferably not less than 6) (preferably alpha-amino acid) although amino acids include acidic amino acids wherein the number of (acidic) carboxyl groups is larger than the number of (basic) amino groups, basic amino acids wherein the number of amino groups is larger than the number of carboxyl groups, and other neutral amino acids. The amino acid is added before the reducing agent is added. Even if an amino acid having a carbon number of not larger than 4 such as alanine having a carbon number of 3, or an acidic amino acids such as aspartic acid or glutamic acid, is added, it is not possible to produce a spherical silver powder which can sufficiently sinter the silver particles thereof to cause the silver particles to be adhered to each other at a relatively low temperature to form a conductive film having a low volume resistivity when it is used for a baked type conductive paste. The amino acid to be added is preferably at least one selected from the group consisting of proline, tyrosine, tryptophan, phenylalanine, arginine, histidine and anthranilic acid. The amount of the amino acid to be added is preferably 0.05 to 6% by weight, more preferably 0.1 to 5% by weight, still more preferably 0.2 to 4% by weight, and most preferably 0.2 to 2% by weight, with respect to silver in the water reaction system. If the amount of the amino acid to be added is not larger than 2% by weight, the number of kinds of organic vehicles capable of being used is increased in order to allow a conductive film to be easily formed by preventing the viscosity of a conductive paste from being increased when the spherical silver powder is used for a baked type conductive paste.

As the reducing agent, there may be used a reducing agent for depositing silver particles by reduction. For example, there may be used at least one of ascorbic acid, hydrogen peroxide water, formic acid, tartaric acid, hydroquinone, pyrogallol, glucose, gallic acid, formalin, hydrazine, hydrazine compounds, alkanolamines and so forth, and there is preferably used formalin, hydrazine or any one of hydrazine compounds. If such a reducing agent is used, it is possible to obtain a spherical silver powder having the above-described particle diameter. The amount of the reducing agent to be added is preferably an equivalent of not less than 1 with respect to silver in order to enhance the yield of silver, and preferably an equivalent of not less than 2 with respect to silver when a reducing agent having a weak reducing power is used. For example, it may be an equivalent of 10 to 20 with respect to silver.

The reducing agent is preferably added at a rate of an equivalent of not less than 1 per minute in order to prevent the spherical silver powder from being agglutinated. It is considered that the dispersability of the spherical silver powder is improved since the deposition of the silver particles by reduction is caused at a stroke to complete the reduction reaction in a short period of time to cause the produced nucleuses to be difficult to be agglutinated to each other if the reducing agent is added in the short period of time, although there is no clear reason. Therefore, the addition time of the reducing agent is preferably shorter, and the reaction solution is preferably stirred so as to complete the reaction in a shorter period of time during the reduction. The temperature during the reduction reaction is preferably 5 to 80° C., and more preferably 5 to 40° C. After the silver particles are deposited by reduction by means of the reducing agent, a surface treatment agent is preferably added to be adhered to the surface of the silver particles. As this surface treatment agent, there may be used fatty acids, fatty acid salts, surfactants, organic metal compounds, chelating agents, polymeric dispersants or the like. As the fatty acids and fatty acid salts, there may be used propionic acid, caprylic acid, lauric acid, myristic acid, palmitic acid, stearic acid, behenic acid, acrylic acid, oleic acid, linoleic acid, arachidonic acid, ricinoleic acid, and salts and emulsions thereof. As the chelating agents, there may be used azoles such as benzotriazole, salts thereof, succinic acid, malonic acid, glutaric acid, adipic acid or the like.

The silver containing slurry obtained by depositing the silver particles by reduction is preferably solid-liquid separated, and the solid body thus obtained is preferably washed with pure water to remove impurities therein. The terminal of washing can be determined by the electrical conductivity of water after washing. The washing is preferably carried out until the electrical conductivity is reduced to be 0.5 mS/m or less.

Since the massive cake obtained after washing contains a large amount of water, it is preferably dried by means of a drier such as a vacuum drier to obtain a dried spherical silver powder. The drying temperature is preferably 100° C. or lower in order to prevent the spherical silver particles from being sintered to be adhered to each other during drying.

The silver powder thus obtained may be subjected to a dry-pulverizing and/or classification process. In place of the pulverizing, the spherical silver powder may be subjected to a surface smoothing process for smoothing the irregularities and angular portions on the surface of the particles of the spherical silver powder by putting the spherical silver powder into an apparatus, which is capable of mechanically fluidizing particles, to mechanically cause the particles of the spherical silver powder to collide with each other. After the pulverizing or surface smoothing process is carried out, a classification process may be carried out. The drying, pulverizing and classification processes may be carried out by means of an integrated apparatus capable of carrying out the drying, pulverizing and classification processes.

The preferred embodiment of a spherical silver powder according to the present invention can be produced by the above-described method for producing a spherical silver powder. The preferred embodiment of a spherical silver powder according to the present invention, comprises: spherical silver particles; and an amino acid which has a carbon number of not less than 5 and which is neutral or basic, the amino acid being contained in each of the spherical silver particles, wherein the spherical silver powder has an average particle diameter $D_{50}$ of 0.2 to 5 μm based on a laser diffraction method.

This spherical silver powder has a substantially spherical external form (more preferably having an aspect ratio (major axis/minor axis) of not greater than 1.5). The spherical silver powder has an average particle diameter $D_{50}$ of 0.2 to 5 μm (preferably 0.5 to 4 μm, and more preferably 1.1 to 3.5 μm) based on a laser diffraction method. If the average particle diameter $D_{50}$ of the spherical silver powder based on the laser diffraction method is too large, it is difficult to describe fine wires when the spherical silver powder is used for preparing a conductive paste to describe wires or the like. On the other hand, if the average particle diameter $D_{50}$ of the spherical silver powder based on the laser diffraction method is too small, it is difficult to increase the concentration of silver in the conductive paste, so that there is same possibility that the wires or the like may be broken. Furthermore, in the volume-based particle diameter distribution of the spherical silver powder, the width of the peak is preferably narrow, and the variation in particle size is preferably small, so that the range of the particle size is preferably narrow.

The amino acid contained in each of the particles of the spherical silver powder is preferably at least one selected from the group consisting of proline, tyrosine, tryptophan, phenylalanine, arginine, histidine and anthranilic acid. The amount of the amino acid contained in the particles of the spherical silver powder is preferably (detectable) 0.00001% by weight or more and 1% by weight or less. The amount of the amino acid existing on the surface of the particles of the spherical silver powder is preferably 0.0001% by weight or more and 1% by weight or less. The total of the amount of the amino acid contained in the particles of the spherical silver powder and the amount of the amino acid existing on the surface thereof is preferably 0.001% by weight or more and 2% by weight or less.

The BET specific surface area of the spherical silver powder is preferably 0.1 to 3 $m^2/g$, and more preferably 0.2 to 2 $m^2/g$. If the BET specific surface area of the spherical silver powder is smaller than 0.1 $m^2/g$, the particles of the spherical silver powder are larger. If such a large spherical silver powder is used for preparing a conductive paste to describe wires or the like, it is difficult to describe fine wires. On the other hand, if the BET specific surface area of the spherical silver powder is larger than 3 $m^2/g$, the viscosity of the conductive paste is too high, so that it is required to dilute the conductive paste to be used. For that reason, the concentration of silver in the conductive paste is lowered, so that there is some possibility that the wires or the like may be broken.

The shrinking percentage of the spherical silver powder preferably reaches 50% at a temperature of not higher than 460° C. (more preferably reaches 50% at a temperature of not higher than 458° C.) when the spherical silver powder is heated. Furthermore, throughout the specification, the expression "shrinking percentage of a spherical silver powder when the spherical silver powder is heated" means a shrinking percentage of a pellet when the temperature of the pellet is raised at a rate of temperature increase of 10° C./min. from a room temperature to 900° C. (a percentage of the reduced length of the pellet to a difference between the length of the pellet at the room temperature and the most contracted length of the pellet), the pellet being a substantially cylindrical pellet (having a diameter of 5 mm) produced by applying a load of 50 kgf for 1 minute to the spherical silver powder.

The crystalline diameter (Dx) of the spherical silver powder is preferably 500 angstrom or less, and more preferably 300 angstrom or less. Furthermore, if the crystalline diameter of the spherical silver powder is thus small, it is possible to lower the temperature at which the shrinking percentages of the spherical silver powder reaches 50% when the spherical silver powder is heated. Thus, it is possible to form a conductive film having a low volume resistivity when the spherical silver powder is used for a backed type conductive paste.

EXAMPLES

Examples of a spherical silver powder and a method for producing the same according to the present invention will be described below in detail.

Example 1

First, 155 g of an industrial ammonia water having a concentration of 28% by weight was added to 3.5 L of an aqueous silver nitrate solution containing 0.12 mol/L of silver ions to form a silver ammine complex solution. The pH of the silver ammine complex solution was adjusted by adding 5.5 g of an aqueous sodium hydroxide solution having a concentration of 20% by weight thereto. Then, 13.99 g of an aqueous L-phenylalanine solution containing 2.4% by weight of L-phenylalanine (0.68% by weight of L-phenylalanine with respect to silver), which was prepared by dissolving L-phenylalanine (special grade produced by Wako Pure Chemical Industries, Ltd., molecular weight=165.19, neutral, carbon number=9) in pure water, was added to the pH-adjusted silver ammine complex solution. While the liquid temperature of the solution was maintained at 20° C., there was added thereto an aqueous solution prepared by diluting 240 g of an aqueous formalin solution having a concentration of 37% by weight serving as a reducing agent with 144 g of pure water, and the solution was sufficiently stirred to obtain a slurry containing silver particles. Thereafter, the stirring was stopped to precipitate silver particles, and the obtained solution (or slurry) containing the precipitated silver particles was filtrated. The solid body thus obtained was washed with water until the electrical conductivity was reduced to be 0.5 mS/m or less. After the washed solid body was dried, it was pulverized to obtain a silver powder.

The silver powder thus obtained was observed at a magnification of 10,000 by means of a scanning electron microscope (SEM). As a result, it was confirmed that the shape of the silver powder was spherical.

The BET specific surface area of the obtained spherical silver powder was measured by the single point BET method by means of a BET specific surface area measuring apparatus (Monosorb HM-model 1210 produced by Mountech Co. Ltd.) after the interior of the measuring apparatus was degassed by causing an Ne—$N_2$ mixed gas (nitrogen: 30%) to flow therein at 60° C. for 10 minutes. As a result, the BET specific surface area was 0.55 $m^2/g$.

The particle diameter distribution of the obtained spherical silver powder was measured by means of a laser diffraction particle size analyzer (Microtrac Particle Size Analyzer MT-3300EX11 produced by Microtrac BEL Corporation), to obtain particle diameters $D_{10}$, $D_{50}$ and $D_{90}$ corresponding to 10%, 50% and 90% of accumulation in volume-based cumulative distribution of the spherical silver powder, respectively. As a result, the particle diameters $D_{10}$, $D_{50}$ and $D_{90}$ were 1.2 μm, 2.1 μm and 3.9 μm, respectively.

Then, 30 mL of an aqueous chloric acid solution prepared by mixing hydrochloric acid (for precision analysis produced by Kanto Chemical Co., Inc. (concentration: 35-37% by weight)) with pure water in a volume ratio of 1:1 was added to 5 g of the obtained spherical silver powder, heated at 150° C. for 15 minutes, and allowed to be cooled. The solution thus obtained was filtered to obtain a filtrate. The filtrate thus obtained was diluted with the same aqueous hydrochloric acid solution as the above-described hydrochloric acid solution to cause the volume thereof to be a constant volume of 50 mL, and further diluted with ultrapure water fifty thousand times to be analyzed by means of a liquid chromatography-mass spectrometer (LC/MC) (Agilent 6470 Triple Quadrupole LC/MS produced by Agilent Technologies Co., Ltd.). As a result, 2.2 mg of L-phenylalanine per 1 g of silver was detected. Since silver is not dissolved in hydrochloric acid, it was confirmed that 0.22% by weight of L-phenylalanine existed on the surface of the spherical silver powder.

Then, 30 mL of hydrochloric acid (for precision analysis produced by Kanto Chemical Co., Inc. (concentration: 35-37% by weight)) was added to 5 g of the obtained spherical silver powder, irradiated with ultrasonic waves for 10 minutes, heated at 150° C. for 15 minutes, and allowed to be cooled. The solution thus obtained was filtered to obtain a silver powder. The silver powder thus obtained was washed with pure water to remove L-phenylalanine on the surface thereof, and heated at 73° C. for 1 hour by means of a vacuum drier to be dried. Thereafter, 4 mL of an aqueous nitric acid solution prepared by mixing nitric acid (for precision analysis produced by Kanto Chemical Co., Inc. (concentration: 60-61%)) with pure water in a volume ratio of 1:1 was added to 1.0 g of the dried spherical silver powder to dissolve the spherical silver powder therein with ultrasonic waves. Then, 6 mL of pure water was added to the obtained solution to cause the volume of the solution to be 10 mL, and from this solution, 5 mL of the solution was distributed. This distributed solution was diluted with pure water to cause the volume thereof to be 50 mL, and from this diluted solution, 100 μL of the diluted solution was distributed. Then, 800 μL of acetonitrile (for LC/MS produced by Kanto Chemical Co., Inc.), and 100 μL of an aqueous solution containing 0.1% by weight of acetic acid (for high-performance liquid chromatography produced by Kanto Chemical Co., Inc.) and 10 mM of ammonium acetate (special grade produced by Kanto Chemical Co., Inc.), were added to the distributed solution to cause the volume thereof to be a constant volume of 1.0 mL, and then, the solution having the constant volume was analyzed by means of the above-described liquid chromatography-mass spectrometer (LC/MC). As a result, it was confirmed that 0.0008% by weight of L-phenylalanine was contained in the particles of the spherical silver powder.

Then, 10 mL of an aqueous nitric acid solution prepared by mixing nitric acid (for precision analysis produced by Kanto Chemical Co., Inc. (60-61%)) with pure water in a volume ratio of 1:1 was added to 1.0 g of the obtained spherical silver powder to completely dissolve the spherical silver powder therein with ultrasonic waves. The solution thus obtained was diluted with ultrapure water ten thousand times to be analyzed by means of the above-described liquid chromatography-mass spectrometer (LC/MC). As a result, 0.19% by weight of L-phenylalanine was detected from the whole silver particles of the spherical silver powder.

A pellet forming apparatus was used for applying a load of 50 kgf for 1 minute to the obtained spherical silver powder to prepare a substantially cylindrical pellet (having a diameter of 5 mm). This pellet was set in a thermomechanical analyzing (TMA) apparatus (TMA8311 produced by Rigaku Corporation) to raise the temperature of the pellet at a rate of temperature increase of 10° C./min. from a room temperature to 900° C. in the atmosphere to measure a shrinking percentage of the pellet (a percentage of the reduced length c of the pellet to a difference (a-c) between the length a of the pellet at the room temperature and the most contracted length b of the pellet) ($=c\times100/(a-b)$). As a result, the shrinking percentage reached 50% at a temperature of 439° C.

After 3 g of the obtained spherical silver powder was measured (the measured weight being W1) to be put in a magnetic melting pot to be ignited at 800° C. for 30 minutes by means of an electric furnace (KM-1302 produced by Advantech Co., Ltd.), the spherical silver powder was cooled to measure the weight (w2) thereof again. Then, an ignition loss (Ig-loss) was obtained from the formula "ignition loss (%)=(w1−w2)×100/w1". As a result, the ignition loss was 1.18%.

The evaluation of the X-ray diffraction (XRD) of the obtained spherical silver powder was carried out in a range of from 30°/2θ to 50°/2θ by means of an X-ray diffractometer (Smart Lab produced by Rigaku Corporation) using a CuKα radiation source (45 kV/200 mA). Then, the half-power band width β on the (111) plane of the spherical silver powder obtained from the X-ray diffraction was used for calculating a crystalline diameter (Dx) from the Scherrer equation $D=(K\cdot\lambda)/(\beta\cdot\cos\theta)$. As a result, the crystalline diameter (Dx) was 225 angstroms. Furthermore, in the Scherrer equation, D denotes a crystallite diameter (angstrom), and λ denotes the wavelength (angstrom) of measuring X-rays, β denoting the broadening of diffracted rays based on the crystallite, θ denoting a Bragg angle of the angle of diffraction and K denoting the Scherrer constant. In this equation, a wavelength of 1.54 angstroms was used as the wavelength of the measuring X-rays, and 0.94 was used as the Scherrer constant K.

Example 2

First, 0.635 g of an aqueous solution containing 15.5% by weight of stearic acid serving as a surface treatment agent was added to the slurry containing silver particles obtained by the same method as that in Example 1. After the solution (or slurry) was sufficiently stirred, the stirring was stopped to precipitate silver particles, and the obtained solution (or slurry) containing the precipitated silver particles was filtrated. The solid body thus obtained was washed with water. After the washed solid body was dried, it was pulverized to obtain a silver powder.

The silver powder thus obtained was observed at a magnification of 10,000 by means of a scanning electron microscope (SEM). As a result, it was confirmed that the shape of the silver powder was spherical. With respect to the obtained spherical silver powder, the BET specific surface area and particle diameter distribution thereof were measured by the same methods as those in Example 1, and the surface and interior thereof were analyzed by the same methods as those in Example 1. In addition, the shrinking percentage thereof based on the thermomechanical analysis (TMA) was measured by the same method as that in Example 1, and the ignition loss (Ig-loss) thereof was calculated by the same method as that in Example 1. Moreover, the crystalline diameter (Dx) thereof was obtained by the same method as that in Example 1. As a result, the BET specific surface area was 0.72 $m^2/g$. The particle diameters $D_{10}$, $D_{50}$ and $D_{90}$ were 0.9 μm, 1.4 μm and 2.1 μm, respectively. In addition, 2.3 mg of L-phenylalanine per 1 g of silver was detected, and it was confirmed that 0.23% by weight of L-phenylalanine existed on the surface of the spherical silver powder. It was also confirmed that 0.0018% by weight of L-phenylalanine was contained in the particles of the spherical silver powder, and L-phenylalanine was detected from the whole particles of the spherical silver powder. The shrinking percentage thereof (based on TMA) reached 50% at a temperature of 402° C., and the ignition loss (Ig-loss) thereof was 1.14%. The crystalline diameter (Dx) thereof was 270 angstroms.

After 18.0 g of the obtained spherical silver powder was mixed (preliminary kneaded) with 2.0 g of a solution serving as an organic vehicle (prepared by mixing ethyl cellulose with 2,2,4-trimethyl-1,3-pentane diol monoisobutyrate in a weight ratio of 92:8) by means of a planetary centrifugal vacuum degassing mixer (Awatori Rentaro produced by Thinky Corporation), the obtained mixture was kneaded by means of a three-roll mill (80S produced by EXAKT Inc.) to obtain a conductive paste. The conductive paste thus obtained was printed on a silicon substrate by means of a screen-printing machine (MT-320T produced by Micro-Tec Co., Ltd.) so as to form a linear film having a width of 250 μm×a length of 55 mm. After the linear film thus formed was heated at 200° C. for 10 minutes by means of a hot air type dryer to be preliminary fired, it was fired at a peak temperature of 770° C. for an in-out time of 22.9 seconds in a fast firing IR furnace (Fast Firing Test Four-Chamber Furnace produced by NGK Insulators Ltd.). The average thickness of the conductive film thus obtained was measured by means of a surface roughness/contour shape measuring apparatus (SURFCOM 480B-12 produced by Tokyo Seiki Co., Ltd.). As a result, the average thickness thereof was 15.4 μm. The resistance value of the conductive film was measured by means of a digital multimeter (R6551 produced by Advantest Corporation). As a result, the resistance value thereof was 0.288 Ω. The volume resistivity of the conductive film was calculated (from the resistance value and volume thereof, the volume being obtained from the thickness, line width and length thereof). As a result, the volume resistivity was 2.01 μΩ·cm.

With respect to a conductive film obtained by the same method as the above-described method, except that the peak temperature during firing was 720° C., the average thickness and resistance value thereof were measured by the same methods as the above-described methods, and the volume resistivity thereof was calculated by the same method as the above-described method. As a result, the average thickness thereof was 15.5 μm, and the resistance value thereof was 0.301 Ω. The volume resistivity thereof was 2.12 μΩ·cm.

Example 3

First, 155 g of an industrial ammonia water having a concentration of 28% by weight was added to 3.5 L of an aqueous silver nitrate solution containing 0.12 mol/L of silver ions to form a silver ammine complex solution. The pH of the silver ammine complex solution was adjusted by adding 4.9 g of an aqueous sodium hydroxide solution having a concentration of 20% by weight thereto. Then, 4.17 g of an aqueous L-tryptophan solution containing 10% by weight of L-tryptophan (0.84% by weight of L-tryptophan with respect to silver), which was prepared by dissolving L-tryptophan (produced by Wako Pure Chemical Industries, Ltd., molecular weight=204.23, neutral, carbon number=11) in 3.757 g of an aqueous sodium hydroxide solution having a concentration of 3.0% by weight, was added to the pH-adjusted silver ammine complex solution. While the liquid temperature of the solution was maintained at 20° C., there was added thereto an aqueous solution prepared by diluting 240 g of an aqueous formalin solution having a concentration of 37% by weight serving as a reducing agent with 144 g of pure water, and the solution was sufficiently stirred to obtain a slurry containing silver particles. Thereafter, the stirring was stopped to precipitate silver particles, and the obtained solution (or slurry) containing the precipitated silver particles was filtrated. The solid body thus obtained was washed with water. After the washed solid body was dried, it was pulverized to obtain a silver powder.

The silver powder thus obtained was observed at a magnification of 10,000 by means of a scanning electron microscope (SEM). As a result, it was confirmed that the shape of the silver powder was spherical. With respect to the obtained spherical silver powder, the BET specific surface area and particle diameter distribution thereof were measured by the same methods as those in Example 1, and the surface and interior thereof were analyzed by the same methods as those in Example 1. In addition, the shrinking percentage thereof based on the thermomechanical analysis (TMA) was measured by the same method as that in Example 1, and the ignition loss (Ig-loss) thereof was calculated by the same method as that in Example 1. Moreover, the crystalline diameter (Dx) thereof was obtained by the same method as that in Example 1. As a result, the BET specific surface area was 1.22 $m^2/g$. The particle diameters $D_{10}$, $D_{50}$ and $D_{90}$ were 0.7 μm, 1.4 μm and 2.5 μm, respectively. In addition, it was confirmed that 0.003% by weight of L-tryptophan existed on the surface of the spherical silver powder. It was also confirmed that 0.54% by weight of L-phenylalanine (nitrogenized with nitric acid) was contained in the particles of the spherical silver powder, and L-tryptophan (nitrogenized with nitric acid) was detected from the whole particles of the spherical silver powder. The shrinking percentage thereof (based on TMA) reached 50% at a temperature of 380° C., and the ignition loss (Ig-loss) thereof was 1.46%. The crystalline diameter (Dx) thereof was 175 angstroms.

Example 4

First, 0.635 g of an aqueous solution containing 15.5% by weight of stearic acid serving as a surface treatment agent was added to the slurry containing silver particles obtained by the same method as that in Example 3. After the solution was sufficiently stirred, the stirring was stopped to precipitate silver particles, and the obtained solution (or slurry) containing the precipitated silver particles was filtrated. The solid body thus obtained was washed with water. After the washed solid body was dried, it was pulverized to obtain a silver powder.

The silver powder thus obtained was observed at a magnification of 10,000 by means of a scanning electron microscope (SEM). As a result, it was confirmed that the shape of the silver powder was spherical. With respect to the obtained spherical silver powder, the BET specific surface area and particle diameter distribution thereof were measured by the same methods as those in Example 1, and the surface and interior thereof were analyzed by the same methods as those in Example 1. In addition, the shrinking percentage thereof based on the thermomechanical analysis (TMA) was measured by the same method as that in Example 1, and the ignition loss (Ig-loss) thereof was calculated by the same method as that in Example 1. Moreover, the crystalline diameter (Dx) thereof was obtained by the same method as that in Example 1. As a result, the BET specific surface area was 0.70 $m^2/g$. The particle diameters $D_{10}$, $D_{50}$ and $D_{90}$ were 1.0 μm, 1.7 μm and 2.7 μm, respectively. In addition, it was confirmed that 0.0098% by weight of L-tryptophan existed on the surface of the spherical silver powder. It was also confirmed that 0.12% by weight of L-tryptophan and 0.012% by weight of L-tryptophan (nitrogenized with nitric acid) were contained in the particles of the spherical silver powder, and L-tryptophan (nitrogenized with nitric acid) was detected from the whole particles of the spherical silver powder. The shrinking percentage thereof (based on TMA) reached 50% at a temperature of 388° C., and the ignition loss (Ig-loss) thereof was 1.53%. The crystalline diameter (Dx) thereof was 190 angstroms.

The obtained spherical silver powder was used for producing a conductive paste and a conductive film by the same methods as those in Example 2. The average thickness and resistance value of the conductive film thus produced were measured by the same methods as those in Example 2, and the volume resistivity thereof was calculated by the same method as that in Example 2. As a result, when the peak temperature during firing was 770° C., the average thickness thereof was 15.2 μm, the resistance value thereof was 0.306 Ω, and the volume resistivity thereof was 2.11 μΩ·cm. When the peak temperature during firing was 720° C., the average thickness thereof was 14.7 μm, the resistance value thereof was 0.304 Ω, and the volume resistivity thereof was 2.03 μΩ·cm.

Example 5

First, 1.55 g of an industrial ammonia water having a concentration of 28% by weight was added to 3.2 L of an aqueous silver nitrate solution containing 0.12 mol/L of silver ions to form a silver ammine complex solution. The pH of the silver ammine complex solution was adjusted by adding 5.5 g of an aqueous sodium hydroxide solution having a concentration of 20% by weight thereto. Then, 300 g of an aqueous L-tyrosine solution containing 0.12% by weight of L-tyrosine (0.75% by weight of L-tyrosine with respect to silver), which was prepared by dissolving L-tyrosine (produced by Wako Pure Chemical Industries, Ltd., molecular weight=181.19, neutral, carbon number=9) in pure water, was added to the pH-adjusted silver ammine complex solution. While the liquid temperature of the solution was maintained at 20° C., there was added thereto an aqueous solution prepared by diluting 210 g of an aqueous formalin solution having a concentration of 37% by weight serving as a reducing agent with 144 g of pure water, and the solution was sufficiently stirred to obtain a slurry containing silver particles. Thereafter, the stirring was stopped to precipitate silver particles, and the obtained solution (or slurry) containing the precipitated silver particles was filtrated. The solid body thus obtained was washed with water. After the washed solid body was dried, it was pulverized to obtain a silver powder.

The silver powder thus obtained was observed at a magnification of 10,000 by means of a scanning electron microscope (SEM). As a result, it was confirmed that the shape of the silver powder was spherical. With respect to the obtained spherical silver powder, the BET specific surface area and particle diameter distribution thereof were measured by the same methods as those in Example 1, and the surface and interior thereof were analyzed by the same methods as those in Example 1. In addition, the shrinking percentage thereof based on the thermomechanical analysis (TMA) was measured by the same method as that in Example 1, and the ignition loss (Ig-loss) thereof was calculated by the same method as that in Example 1. Moreover, the crystalline diameter (Dx) thereof was obtained by the same method as that in Example 1. As a result, the BET specific surface area was 0.99 $m^2/g$. The particle diameters $D_{10}$, $D_{50}$ and $D_{90}$ were 0.8 μm, 1.6 μm and 2.9 μm, respectively. In addition, it was confirmed that 0.098% by weight of L-tyrosine existed on the surface of the spherical silver powder. It was also confirmed that 0.0008% by weight of L-tyrosine and 0.0012% by weight of L-tyrosine (nitrogenized with nitric acid) were contained in the particles of the spherical silver powder, and L-tyrosine (nitrogenized with nitric acid) was detected from the whole particles of the spherical silver powder. The shrinking percentage thereof (based on TMA) reached 50% at a temperature of 417° C., and the ignition loss (Ig-loss) thereof was 1.35%. The crystalline diameter (Dx) thereof was 190 angstroms.

Example 6

First, 0.635 g of an aqueous solution containing 15.5% by weight of stearic acid serving as a surface treatment agent was added to the slurry containing silver particles obtained by the same method as that in Example 5. After the solution was sufficiently stirred, the stirring was stopped to precipitate silver particles, and the obtained solution (or slurry) containing the precipitated silver particles was filtrated. The solid body thus obtained was washed with water. After the washed solid body was dried, it was pulverized to obtain a silver powder.

The silver powder thus obtained was observed at a magnification of 10,000 by means of a scanning electron microscope (SEM). As a result, it was confirmed that the shape of the silver powder was spherical. With respect to the obtained spherical silver powder, the BET specific surface area and particle diameter distribution thereof were measured by the same methods as those in Example 1, and the surface and interior thereof were analyzed by the same methods as those in Example 1. In addition, the shrinking percentage thereof based on the thermomechanical analysis (TMA) was measured by the same method as that in Example 1, and the ignition loss (Ig-loss) thereof was calculated by the same method as that in Example 1. Moreover, the crystalline diameter (Dx) thereof was obtained by the same method as that in Example 1. As a result, the BET specific surface area was 0.60 $m^2/g$. The particle diameters $D_{10}$, $D_{50}$ and $D_{90}$ were 1.0 μm, 1.7 μm and 2.8 μm, respectively. In addition, it was confirmed that L-tyrosine existed on the surface of the spherical silver powder. It was also confirmed that 0.0002% by weight of L-tyrosine (nitrogenized with nitric acid) was contained in the particles of the spherical silver powder, and L-tyrosine (nitrogenized with nitric acid) was detected from the whole particles of the spherical silver powder. The shrinking percentage thereof (based on TMA) reached 50% at a temperature of 381° C., and the ignition loss (Ig-loss) thereof was 1.29%. The crystalline diameter (Dx) thereof was 210 angstroms.

The obtained spherical silver powder was used for producing a conductive paste and a conductive film by the same methods as those in Example 2. The average thickness and resistance value of the conductive film thus produced were measured by the same methods as those in Example 2, and the volume resistivity thereof was calculated by the same method as that in Example 2. As a result, when the peak temperature during firing was 770° C., the average thickness thereof was 15.6 μm, the resistance value thereof was 0.306 Ω, and the volume resistivity thereof was 2.17 μΩ·cm. When the peak temperature during firing was 720° C., the average thickness thereof was 15.8 μm, the resistance value thereof was 0.319 Ω, and the volume resistivity thereof was 2.29 μΩ·cm.

Example 7

First, 155 g of an industrial ammonia water having a concentration of 28% by weight was added to 3.5 L of an aqueous silver nitrate solution containing 0.12 mol/L of silver ions to form a silver ammine complex solution. The pH of the silver ammine complex solution was adjusted by adding 5.5 g of an aqueous sodium hydroxide solution having a concentration of 20% by weight thereto. Then, 2.35 g of an aqueous L-proline solution containing 10% by weight of L-proline (0.47% by weight of L-proline with respect to silver), which was prepared by dissolving L-proline (produced by Wako Pure Chemical Industries, Ltd., molecular weight=115.13, neutral, carbon number=5) in pure water, was added to the pH-adjusted silver ammine complex solution. While the liquid temperature of the solution was maintained at 20° C., there was added thereto an aqueous solution prepared by diluting 240 g of an aqueous formalin solution having a concentration of 37% by weight serving as a reducing agent with 144 g of pure water, and the solution was sufficiently stirred to obtain a slurry containing silver particles. Thereafter, the stirring was stopped to precipitate silver particles, and the obtained solution (or slurry) containing the precipitated silver particles was filtrated. The solid body thus obtained was washed with water. After the washed solid body was dried, it was pulverized to obtain a silver powder.

The silver powder thus obtained was observed at a magnification of 10,000 by means of a scanning electron microscope (SEM). As a result, it was confirmed that the shape of the silver powder was spherical. With respect to the obtained spherical silver powder, the BET specific surface area and particle diameter distribution thereof were measured by the same methods as those in Example 1, and the surface and interior thereof were analyzed by the same methods as those in Example 1. In addition, the shrinking percentage thereof based on the thermomechanical analysis (TMA) was measured by the same method as that in Example 1, and the ignition loss (Ig-loss) thereof was calculated by the same method as that in Example 1. Moreover, the crystalline diameter (Dx) thereof was obtained by the same method as that in Example 1. As a result, the BET specific surface area was 0.81 $m^2/g$. The particle diameters $D_{10}$, $D_{50}$ and $D_{90}$ were 0.8 μm, 1.7 μm and 3.0 μm, respectively. In addition, it was confirmed that 0.013% by weight of L-proline existed on the surface of the spherical silver powder. It was also confirmed that 0.00003% by weight of L-proline was contained in the particles of the spherical silver powder, and L-proline was detected from the whole particles of the spherical silver powder. The shrinking percentage thereof (based on TMA) reached 50% at a temperature of 457° C., and the ignition loss (Ig-loss) thereof was 0.85%. The crystalline diameter (Dx) thereof was 250 angstroms.

Example 8

First, 0.635 g of an aqueous solution containing 15.5% by weight of stearic acid serving as a surface treatment agent was added to the slurry containing silver particles obtained by the same method as that in Example 7. After the solution was sufficiently stirred, the stirring was stopped to precipitate silver particles, and the obtained solution (or slurry) containing the precipitated silver particles was filtrated. The solid body thus obtained was washed with water. After the washed solid body was dried, it was pulverized to obtain a silver powder.

The silver powder thus obtained was observed at a magnification of 10,000 by means of a scanning electron microscope (SEM). As a result, it was confirmed that the shape of the silver powder was spherical. With respect to the obtained spherical silver powder, the BET specific surface area and particle diameter distribution thereof were measured by the same methods as those in Example 1, and the surface and interior thereof were analyzed by the same methods as those in Example 1. In addition, the shrinking percentage thereof based on the thermomechanical analysis (TMA) was measured by the same method as that in Example 1, and the ignition loss (Ig-loss) thereof was calculated by the same method as that in Example 1. Moreover, the crystalline diameter (Dx) thereof was obtained by the same method as that in Example 1. As a result, the BET specific surface area was 0.53 $m^2/g$. The particle diameters $D_{10}$, $D_{50}$ and $D_{90}$ were 1.0 μm, 1.6 μm and 2.5 μm, respectively. In addition, it was confirmed that L-proline existed on the surface of the spherical silver powder. It was also confirmed that 0.0009% by weight of L-proline was contained in the particles of the spherical silver powder, and L-proline was detected from the whole particles of the spherical silver powder. The shrinking percentage thereof (based on TMA) reached 50% at a temperature of 446° C., and the ignition loss (Ig-loss) thereof was 0.88%. The crystalline diameter (Dx) thereof was 270 angstroms.

The obtained spherical silver powder was used for producing a conductive paste and a conductive film by the same methods as those in Example 2. The average thickness and resistance value of the conductive film thus produced were measured by the same methods as those in Example 2, and the volume resistivity thereof was calculated by the same method as that in Example 2. As a result, when the peak temperature during firing was 770° C., the average thickness thereof was 14.9 μm, the resistance value thereof was 0.320 Ω, and the volume resistivity thereof was 2.17 μΩ·cm. When the peak temperature during firing was 720° C., the average thickness thereof was 15.1 μm, the resistance value thereof was 0.329 Ω, and the volume resistivity thereof was 2.26 μΩ·cm.

Example 9

First, 155 g of an industrial ammonia water having a concentration of 28% by weight was added to 3.5 L of an aqueous silver nitrate solution containing 0.12 mol/L of silver ions to form a silver ammine complex solution. The pH of the silver ammine complex solution was adjusted by adding 0.16 g of an aqueous sodium hydroxide solution having a concentration of 20% by weight thereto. Then, 7.16 g of an aqueous L-arginine solution containing 5.0% by weight of L-arginine (0.72% by weight of L-arginine with respect to silver), which was prepared by dissolving L-arginine (produced by Wako Pure Chemical Industries, Ltd., molecular weight=174.20, basic, carbon number=6) in 6.7988 g of an aqueous solution containing 1.1% by weight of sodium hydroxide, was added to the pH-adjusted silver ammine complex solution. While the liquid temperature of the solution was maintained at 20° C., there was added thereto an aqueous solution prepared by diluting 240 g of an aqueous formalin solution having a concentration of 37% by weight serving as a reducing agent with 144 g of pure water, and the solution was sufficiently stirred to obtain a slurry containing silver particles. Thereafter, the stirring was stopped to precipitate silver particles, and the obtained solution (or slurry) containing the precipitated silver particles was filtrated. The solid body thus obtained was washed with water. After the washed solid body was dried, it was pulverized to obtain a silver powder.

The silver powder thus obtained was observed at a magnification of 10,000 by means of a scanning electron microscope (SEM). As a result, it was confirmed that the shape of the silver powder was spherical. With respect to the obtained spherical silver powder, the BET specific surface area and particle diameter distribution thereof were measured by the same methods as those in Example 1, and the surface and interior thereof were analyzed by the same methods as those in Example 1. In addition, the shrinking percentage thereof based on the thermomechanical analysis (TMA) was measured by the same method as that in Example 1, and the ignition loss (Ig-loss) thereof was calculated by the same method as that in Example 1. Moreover, the crystalline diameter (Dx) thereof was obtained by the same method as that in Example 1. As a result, the BET specific surface area was 1.05 $m^2/g$. The particle diameters $D_{10}$, $D_{50}$ and $D_{90}$ were 0.8 μm, 1.6 μm and 2.8 μm, respectively. In addition, it was confirmed that 0.42% by weight of L-arginine existed on the surface of the spherical silver powder. It was also confirmed that 0.00004% by weight of L-arginine was contained in the particles of the spherical silver powder, and L-arginine was detected from the whole particles of the spherical silver powder. The shrinking percentage thereof (based on TMA) reached 50% at a temperature of 436° C., and the ignition loss (Ig-loss) thereof was 1.20%. The crystalline diameter (Dx) thereof was 220 angstroms.

Example 10

First, 0.635 g of an aqueous solution containing 15.5% by weight of stearic acid serving as a surface treatment agent was added to the slurry containing silver particles obtained by the same method as that in Example 9. After the solution was sufficiently stirred, the stirring was stopped to precipitate silver particles, and the obtained solution (or slurry) containing the precipitated silver particles was filtrated. The solid body thus obtained was washed with water. After the washed solid body was dried, it was pulverized to obtain a silver powder.

The silver powder thus obtained was observed at a magnification of 10,000 by means of a scanning electron microscope (SEM). As a result, it was confirmed that the shape of the silver powder was spherical. With respect to the obtained spherical silver powder, the BET specific surface area and particle diameter distribution thereof were measured by the same methods as those in Example 1, and the surface and interior thereof were analyzed by the same methods as those in Example 1. In addition, the shrinking percentage thereof based on the thermomechanical analysis (TMA) was measured by the same method as that in Example 1, and the ignition loss (Ig-loss) thereof was calculated by the same method as that in Example 1. Moreover, the crystalline diameter (Dx) thereof was obtained by the same method as that in Example 1. As a result, the BET specific surface area was 0.62 $m^2/g$. The particle diameters $D_{10}$, $D_{50}$ and $D_{90}$ were 0.9 μm, 1.7 μm and 2.7 μm, respectively. In addition, it was confirmed that 0.26% by weight of L-arginine existed on the surface of the spherical silver powder. It was also confirmed that 0.0001% by weight of L-arginine was contained in the particles of the spherical silver powder, and L-arginine was detected from the whole particles of the spherical silver powder. The shrinking percentage thereof (based on TMA) reached 50% at a temperature of 415° C., and the ignition loss (Ig-loss) thereof was 1.63%. The crystalline diameter (Dx) thereof was 220 angstroms.

The obtained spherical silver powder was used for producing a conductive paste and a conductive film by the same methods as those in Example 2. The average thickness and resistance value of the conductive film thus produced were measured by the same methods as those in Example 2, and the volume resistivity thereof was calculated by the same method as that in Example 2. As a result, when the peak temperature during firing was 770° C., the average thickness thereof was 13.9 μm, the resistance value thereof was 0.331 Ω, and the volume resistivity thereof was 2.09 μΩ·cm. When the peak temperature during firing was 720° C., the average thickness thereof was 14.1 μm, the resistance value thereof was 0.327 Ω, and the volume resistivity thereof was 2.09 μΩ·cm.

Example 11

First, 155 g of an industrial ammonia water having a concentration of 28% by weight was added to 3.5 L of an aqueous silver nitrate solution containing 0.12 mol/L of silver ions to form a silver ammine complex solution. The pH of the silver ammine complex solution was adjusted by adding 0.16 g of an aqueous sodium hydroxide solution having a concentration of 20% by weight thereto. Then, 6.36 g of an aqueous L-histidine solution containing 5.0% by weight of L-histidine (0.64% by weight of L-histidine with respect to silver), which was prepared by dissolving L-histidine (produced by Wako Pure Chemical Industries, Ltd., molecular weight=155.16, basic, carbon number=6) in 6.04 g of an aqueous sodium hydroxide solution having a concentration of 5.56% by weight, was added to the pH-adjusted silver ammine complex solution. While the liquid temperature of the solution was maintained at 20° C., there was added thereto an aqueous solution prepared by diluting 240 g of an aqueous formalin solution having a concentration of 37% by weight serving as a reducing agent with 144 g of pure water, and the solution was sufficiently stirred to obtain a slurry containing silver particles. Thereafter, the stirring was stopped to precipitate silver particles, and the obtained solution (or slurry) containing the precipitated silver particles was filtrated. The solid body thus obtained was washed with water. After the washed solid body was dried, it was pulverized to obtain a silver powder.

The silver powder thus obtained was observed at a magnification of 10,000 by means of a scanning electron microscope (SEM). As a result, it was confirmed that the shape of the silver powder was spherical. With respect to the obtained spherical silver powder, the BET specific surface area and particle diameter distribution thereof were measured by the same methods as those in Example 1, and the surface and interior thereof were analyzed by the same methods as those in Example 1. In addition, the shrinking percentage thereof based on the thermomechanical analysis (TMA) was measured by the same method as that in Example 1, and the ignition loss (Ig-loss) thereof was calculated by the same method as that in Example 1. Moreover, the crystalline diameter (Dx) thereof was obtained by the same method as that in Example 1. As a result, the BET specific surface area was 1.47 $m^2/g$. The particle diameters $D_{10}$, $D_{50}$ and $D_{90}$ were 0.8 μm, 1.5 μm and 2.6 μm, respectively. In addition, it was confirmed that 0.22% by weight of L-histidine existed on the surface of the spherical silver powder. It was also confirmed that 0.00035% by weight of L-histidine was contained in the particles of the spherical silver powder, and L-histidine was detected from the whole particles of the spherical silver powder. The shrinking percentage thereof (based on TMA) reached 50% at a temperature of 420° C., and the ignition loss (Ig-loss) thereof was 1.12%. The crystalline diameter (Dx) thereof was 195 angstroms.

Example 12

First, 0.635 g of an aqueous solution containing 15.5% by weight of stearic acid serving as a surface treatment agent was added to the slurry containing silver particles obtained by the same method as that in Example 11. After the solution was sufficiently stirred, the stirring was stopped to precipitate silver particles, and the obtained solution (or slurry) containing the precipitated silver particles was filtrated. The solid body thus obtained was washed with water. After the washed solid body was dried, it was pulverized to obtain a silver powder.

The silver powder thus obtained was observed at a magnification of 10,000 by means of a scanning electron microscope (SEM). As a result, it was confirmed that the shape of the silver powder was spherical. With respect to the obtained spherical silver powder, the BET specific surface area and particle diameter distribution thereof were measured by the same methods as those in Example 1, and the surface and interior thereof were analyzed by the same methods as those in Example 1. In addition, the shrinking percentage thereof based on the thermomechanical analysis (TMA) was measured by the same method as that in Example 1, and the ignition loss (Ig-loss) thereof was calculated by the same method as that in Example 1. Moreover, the crystalline diameter (Dx) thereof was obtained by the same method as that in Example 1. As a result, the BET specific surface area was 1.55 $m^2/g$. The particle diameters $D_{10}$, $D_{50}$ and $D_{90}$ were 0.9 μm, 1.7 μm and 2.7 μm, respectively. In addition, it was confirmed that 0.31 by weight of L-histidine existed on the surface of the spherical silver powder. It was also confirmed that 0.00023% by weight of L-histidine was contained in the particles of the spherical silver powder, and L-histidine was detected from the whole particles of the spherical silver powder. The shrinking percentage thereof (based on TMA) reached 50% at a temperature of 390° C., and the ignition loss (Ig-loss) thereof was 1.25%. The crystalline diameter (Dx) thereof was 205 angstroms.

The obtained spherical silver powder was used for producing a conductive paste and a conductive film by the same methods as those in Example 2, except that there was further added 0.6 g of a solution, which was prepared by mixing 2,2,4-trimethyl-1,3-pentane diol monoisobutyrate with 2-(2-butoxyethoxy) ethyl acetate in a weight ratio of 1:1, when the preliminary kneading was carried out. The average thickness and resistance value of the conductive film thus produced were measured by the same methods as those in Example 2, and the volume resistivity thereof was calculated by the same method as that in Example 2. As a result, when the peak temperature during firing was 770° C., the average thickness thereof was 13.7 μm, the resistance value thereof was 0.350 Ω, and the volume resistivity thereof was 2.17 μΩ·cm. When the peak temperature during firing was 720° C., the average thickness thereof was 14.2 μm, the resistance value thereof was 0.360 Ω, and the volume resistivity thereof was 2.32 μΩ·cm.

Comparative Example 1

First, 155 g of an industrial ammonia water having a concentration of 28% by weight was added to 3.5 L of an aqueous silver nitrate solution containing 0.12 mol/L of silver ions to form a silver ammine complex solution. The pH of the silver ammine complex solution was adjusted by adding 5.5 g of an aqueous sodium hydroxide solution having a concentration of 20% by weight thereto. While the liquid temperature of the solution was maintained at 20° C., there was added thereto an aqueous solution prepared by diluting 240 g of an aqueous formalin solution having a concentration of 37% by weight serving as a reducing agent with 144 g of pure water, and the solution was sufficiently stirred to obtain a slurry containing silver particles. Thereafter, the stirring was stopped to precipitate silver particles, and the obtained solution (or slurry) containing the precipitated silver particles was filtrated. The solid body thus obtained was washed with water. After the washed solid body was dried, it was pulverized to obtain a silver powder.

The silver powder thus obtained was observed at a magnification of 10,000 by means of a scanning electron microscope (SEM). As a result, it was confirmed that the shape of the silver powder was spherical. With respect to the obtained spherical silver powder, the BET specific surface area and particle diameter distribution thereof were measured by the same methods as those in Example 1. In addition, the shrinking percentage thereof based on the thermomechanical analysis (TMA) was measured by the same method as that in Example 1, and the ignition loss (Ig-loss) thereof was calculated by the same method as that in Example 1. Moreover, the crystalline diameter (Dx) thereof was obtained by the same method as that in Example 1. As a result, the BET specific surface area was 0.77 $m^2/g$. The particle diameters $D_{10}$, $D_{50}$ and $D_{90}$ were 0.8 μm, 1.5 μm and 2.3 μm, respectively. The shrinking percentage thereof (based on TMA) reached 50% at a temperature of 462° C., and the ignition loss (Ig-loss) thereof was 0.65%. The crystalline diameter (Dx) thereof was 305 angstroms.

Comparative Example 2

First, 0.635 g of an aqueous solution containing 15.5% by weight of stearic acid serving as a surface treatment agent was added to the slurry containing silver particles obtained by the same method as that in Comparative Example 1. After the solution was sufficiently stirred, the stirring was stopped to precipitate silver particles, and the obtained solution (or slurry) containing the precipitated silver particles was filtrated. The solid body thus obtained was washed with water. After the washed solid body was dried, it was pulverized to obtain a silver powder.

The silver powder thus obtained was observed at a magnification of 10,000 by means of a scanning electron microscope (SEM). As a result, it was confirmed that the shape of the silver powder was spherical. With respect to the obtained spherical silver powder, the BET specific surface area and particle diameter distribution thereof were measured by the same methods as those in Example 1. In addition, the shrinking percentage thereof based on the thermomechanical analysis (TMA) was measured by the same method as that in Example 1, and the ignition loss (Ig-loss) thereof was calculated by the same method as that in Example 1. Moreover, the crystalline diameter (Dx) thereof was obtained by the same method as that in Example 1. As a result, the BET specific surface area was 0.55 $m^2/g$. The particle diameters $D_{10}$, $D_{50}$ and $D_{90}$ were 0.9 μm, 1.4 μm and 2.1 μm, respectively. The shrinking percentage thereof (based on TMA) reached 50% at a temperature of 461° C., and the ignition loss (Ig-loss) thereof was 0.88%. The crystalline diameter (Dx) thereof was 290 angstroms.

The obtained spherical silver powder was used for producing a conductive paste and a conductive film by the same methods as those in Example 2. The average thickness and resistance value of the conductive film thus produced were measured by the same methods as those in Example 2, and the volume resistivity thereof was calculated by the same method as that in Example 2. As a result, when the peak temperature during firing was 770° C., the average thickness thereof was 15.5 μm, the resistance value thereof was 0.362 Ω, and the volume resistivity thereof was 2.55 μΩ·cm. When the peak temperature during firing was 720° C., the average thickness thereof was 15.2 μm, the resistance value thereof was 0.383 Ω, and the volume resistivity thereof was 2.65 μΩ·cm.

Comparative Example 3

First, 155 g of an industrial ammonia water having a concentration of 28% by weight was added to 3.5 L of an aqueous silver nitrate solution containing 0.12 mol/L of silver ions to form a silver ammine complex solution. The pH of the silver ammine complex solution was adjusted by adding 5.5 g of an aqueous sodium hydroxide solution having a concentration of 20% by weight thereto. Then, 3.65 g of an aqueous L-alanine solution containing 5.0% by weight of L-alanine (0.37% by weight of L-alanine with respect to silver), which was prepared by dissolving L-alanine (produced by Wako Pure Chemical Industries, Ltd., molecular weight=89.09, neutral, carbon number=3) in 3.47 g of an aqueous sodium hydroxide solution having a concentration of 5.56% by weight, was added to the pH-adjusted silver ammine complex solution. While the liquid temperature of the solution was maintained at 20° C., there was added thereto an aqueous solution prepared by diluting 240 g of an aqueous formalin solution having a concentration of 37% by weight serving as a reducing agent with 144 g of pure water, and the solution was sufficiently stirred to obtain a slurry containing silver particles. Thereafter, the stirring was stopped to precipitate silver particles, and the obtained solution (or slurry) containing the precipitated silver particles was filtrated. The solid body thus obtained was washed with water. After the washed solid body was dried, it was pulverized to obtain a silver powder.

The silver powder thus obtained was observed at a magnification of 10,000 by means of a scanning electron microscope (SEM). As a result, it was confirmed that the shape of the silver powder was spherical. With respect to the obtained spherical silver powder, the BET specific surface area and particle diameter distribution thereof were measured by the same methods as those in Example 1, and the surface and interior thereof were analyzed by the same methods as those in Example 1. In addition, the shrinking percentage thereof based on the thermomechanical analysis (TMA) was measured by the same method as that in Example 1, and the ignition loss (Ig-loss) thereof was calculated by the same method as that in Example 1. Moreover, the crystalline diameter (Dx) thereof was obtained by the same method as that in Example 1. As a result, the BET specific surface area was 0.66 $m^2/g$. The particle diameters $D_{10}$, $D_{50}$ and $D_{90}$ were 1.1 μm, 2.0 μm and 3.7 μm, respectively. In addition, it was confirmed that 0.017% by weight of L-alanine existed on the surface of the spherical silver powder. It was also confirmed that 0.00002% by weight of L-alanine was contained in the particles of the spherical silver powder, and L-alanine was detected from the whole particles of the spherical silver powder. The shrinking percentage thereof (based on TMA)

reached 50% at a temperature of 477° C., and the ignition loss (Ig-loss) thereof was 0.78%. The crystalline diameter (Dx) thereof was 265 angstroms.

Comparative Example 4

First, 0.635 g of an aqueous solution containing 15.5% by weight of stearic acid serving as a surface treatment agent was added to the slurry containing silver particles obtained by the same method as that in Comparative Example 3. After the solution was sufficiently stirred, the stirring was stopped to precipitate silver particles, and the obtained solution (or slurry) containing the precipitated silver particles was filtrated. The solid body thus obtained was washed with water. After the washed solid body was dried, it was pulverized to obtain a silver powder.

The silver powder thus obtained was observed at a magnification of 10,000 by means of a scanning electron microscope (SEM). As a result, it was confirmed that the shape of the silver powder was spherical. With respect to the obtained spherical silver powder, the BET specific surface area and particle diameter distribution thereof were measured by the same methods as those in Example 1. In addition, the shrinking percentage thereof based on the thermomechanical analysis (TMA) was measured by the same method as that in Example 1, and the ignition loss (Ig-loss) thereof was calculated by the same method as that in Example 1. Moreover, the crystalline diameter (Dx) thereof was obtained by the same method as that in Example 1. As a result, the BET specific surface area was 0.60 $m^2/g$. The particle diameters $D_{10}$, $D_{50}$ and $D_{90}$ were 0.9 μm, 1.5 μm and 2.3 μm, respectively. The shrinking percentage thereof (based on TMA) reached 50% at a temperature of 441° C., and the ignition loss (Ig-loss) thereof was 0.95%. The crystalline diameter (Dx) thereof was 255 angstroms.

The obtained spherical silver powder was used for producing a conductive paste and a conductive film by the same methods as those in Example 2. The average thickness and resistance value of the conductive film thus produced were measured by the same methods as those in Example 2, and the volume resistivity thereof was calculated by the same method as that in Example 2. As a result, when the peak temperature during firing was 770° C., the average thickness thereof was 15.2 μm, the resistance value thereof was 0.358 Ω, and the volume resistivity thereof was 2.47 μΩ·cm. When the peak temperature during firing was 720° C., the average thickness thereof was 15.6 μm, the resistance value thereof was 0.370 Ω, and the volume resistivity thereof was 2.62 μΩ·cm.

Comparative Example 5

First, 155 g of an industrial ammonia water having a concentration of 28% by weight was added to 3.5 L of an aqueous silver nitrate solution containing 0.12 mol/L of silver ions to form a silver ammine complex solution. The pH of the silver ammine complex solution was adjusted by adding 5.5 g of an aqueous sodium hydroxide solution having a concentration of 20% by weight thereto. While the liquid temperature of the solution was maintained at 20° C., there was added thereto an aqueous solution prepared by diluting 240 g of an aqueous formalin solution having a concentration of 37% by weight serving as a reducing agent with 144 g of pure water. Then, 13.99 g of an aqueous L-phenylalanine solution containing 2.4% by weight of L-phenylalanine (0.68% by weight of L-phenylalanine with respect to silver), which was prepared by dissolving L-phenylalanine (special grade produced by Wako Pure Chemical Industries, Ltd., molecular weight=165.19, neutral, carbon number=9) in pure water, was added to the slurry, and 0.635 g of an aqueous solution containing 15.5% by weight of stearic acid serving as a surface treatment agent was added thereto. After the slurry was sufficiently stirred, the stirring was stopped to precipitate silver particles, and the obtained solution (or slurry) containing the precipitated silver particles was filtrated. The solid body thus obtained was washed with water. After the washed solid body was dried, it was pulverized to obtain a silver powder.

The silver powder thus obtained was observed at a magnification of 10,000 by means of a scanning electron microscope (SEM). As a result, it was confirmed that the shape of the silver powder was spherical. With respect to the obtained spherical silver powder, the BET specific surface area and particle diameter distribution thereof were measured by the same methods as those in Example 1, and the surface and interior thereof were analyzed by the same methods as those in Example 1. In addition, the shrinking percentage thereof based on the thermomechanical analysis (TMA) was measured by the same method as that in Example 1, and the ignition loss (Ig-loss) thereof was calculated by the same method as that in Example 1. Moreover, the crystalline diameter (Dx) thereof was obtained by the same method as that in Example 1. As a result, the BET specific surface area was 0.55 $m^2/g$. The particle diameters $D_{10}$, $D_{50}$ and $D_{90}$ were 1.0 μm, 1.4 μm and 2.1 μm, respectively. In addition, it was confirmed that 0.005% by weight of L-phenylalanine existed on the surface of the spherical silver powder. However, it was not confirmed that L-phenylalanine was contained in the particles of the spherical silver powder. The shrinking percentage thereof (based on TMA) reached 50% at a temperature of 461° C., and the ignition loss (Ig-loss) thereof was 0.87%. The crystalline diameter (Dx) thereof was 285 angstroms.

The obtained spherical silver powder was used for producing a conductive paste and a conductive film by the same methods as those in Example 2. The average thickness and resistance value of the conductive film thus produced were measured by the same methods as those in Example 2, and the volume resistivity thereof was calculated by the same method as that in Example 2. As a result, when the peak temperature during firing was 770° C., the average thickness thereof was 14.5 μm, the resistance value thereof was 0.356 Ω, and the volume resistivity thereof was 2.35 μΩ·cm. When the peak temperature during firing was 720° C., the average thickness thereof was 14.2 μm, the resistance value thereof was 0.373 Ω, and the volume resistivity thereof was 2.41 μΩ·cm.

Example 13

First, 162 g of an industrial ammonia water having a concentration of 28% by weight was added to 3.3 L of an aqueous silver nitrate solution containing 0.13 mol/L of silver ions to form a silver ammine complex solution. The pH of the silver ammine complex solution was adjusted by adding 5.86 g of an aqueous sodium hydroxide solution having a concentration of 20% by weight thereto. Then, 6.54 g of an aqueous L-tryptophan solution containing 7% by weight of L-tryptophan (0.84% by weight of L-tryptophan with respect to silver), which was prepared by dissolving L-tryptophan (produced by Wako Pure Chemical Industries, Ltd., molecular weight=204.23, neutral, carbon number=11) in 3.76 g of an aqueous sodium hydroxide solution having a concentration of 2.0% by weight, was added to the pH-adjusted silver ammine complex solution. While the liquid temperature of the solution was maintained at 28° C., there was added thereto an aqueous solution prepared by diluting 250 g of an aqueous formalin solution having a concentration of 37% by weight serving as a reducing agent with 125 g of pure water, and the solution was sufficiently stirred to obtain a slurry containing silver particles. Then, 0.614 g of an aqueous solution containing 15.5% by weight of stearic acid serving as a surface treatment agent was added to the slurry. After the solution thus obtained was sufficiently stirred, the stirring was stopped to precipitate silver particles, and the obtained solution (or slurry) containing the precipitated silver particles was filtrated. The solid body thus obtained was washed with water. After the washed solid body was dried, it was pulverized to obtain a silver powder.

The silver powder thus obtained was observed at a magnification of 10,000 by means of a scanning electron microscope (SEM). As a result, it was confirmed that the shape of the silver powder was spherical. With respect to the obtained spherical silver powder, the BET specific surface area and particle diameter distribution thereof were measured by the same methods as those in Example 1. In addition, the shrinking percentage thereof based on the thermomechanical analysis (TMA) was measured by the same method as that in Example 1, and the ignition loss (Ig-loss) thereof was calculated by the same method as that in Example 1. Moreover, the crystalline diameter (Dx) thereof was obtained by the same method as that in Example 1. As a result, the BET specific surface area was 0.62 $m^2/g$. The particle diameters $D_{10}$, $D_{50}$ and $D_{90}$ were 1.1 μm, 1.9 μm and 3.1 μm, respectively. The shrinking percentage thereof (based on TMA) reached 50% at a temperature of 401° C., and the ignition loss (Ig-loss) thereof was 1.51%. The crystalline diameter (Dx) thereof was 190 angstroms.

The obtained spherical silver powder was used for producing a conductive paste and a conductive film by the same methods as those in Example 2. The average thickness and resistance value of the conductive film thus produced were measured by the same methods as those in Example 2, and the volume resistivity thereof was calculated by the same method as that in Example 2. As a result, when the peak temperature during firing was 770° C., the average thickness thereof was 13.7 μm, the resistance value thereof was 0.330 Ω, and the volume resistivity thereof was 2.05 μΩ·cm. When the peak temperature during firing was 720° C., the average thickness thereof was 14.0 μm, the resistance value thereof was 0.337 Ω, and the volume resistivity thereof was 2.14 μΩ·cm.

Example 14

First, 162 g of an industrial ammonia water having a concentration of 28% by weight was added to 3.3 L of an aqueous silver nitrate solution containing 0.13 mol/L of silver ions to form a silver ammine complex solution. The pH of the silver ammine complex solution was adjusted by adding 6.79 g of an aqueous sodium hydroxide solution having a concentration of 20% by weight thereto. Then, 2.18 g of an aqueous L-tryptophan solution containing 7% by weight of L-tryptophan (0.28% by weight of L-tryptophan with respect to silver), which was prepared by dissolving L-tryptophan (produced by Wako Pure Chemical Industries, Ltd., molecular weight=204.23, neutral, carbon number=11) in 2.03 g of an aqueous sodium hydroxide solution having a concentration of 2.0% by weight, was added to the pH-adjusted silver ammine complex solution. While the liquid temperature of the solution was maintained at 28° C., there was added thereto an aqueous solution prepared by diluting 250 g of an aqueous formalin solution having a concentration of 37% by weight serving as a reducing agent with 125 g of pure water, and the solution was sufficiently stirred to obtain a slurry containing silver particles. Then, 0.614 g of an aqueous solution containing 15.5% by weight of stearic acid serving as a surface treatment agent was added to the slurry. After the solution thus obtained was sufficiently stirred, the stirring was stopped to precipitate silver particles, and the obtained solution (or slurry) containing the precipitated silver particles was filtrated. The solid body thus obtained was washed with water. After the washed solid body was dried, it was pulverized to obtain a silver powder.

The silver powder thus obtained was observed at a magnification of 10,000 by means of a scanning electron microscope (SEM). As a result, it was confirmed that the shape of the silver powder was spherical. With respect to the obtained spherical silver powder, the BET specific surface area and particle diameter distribution thereof were measured by the same methods as those in Example 1. In addition, the shrinking percentage thereof based on the thermomechanical analysis (TMA) was measured by the same method as that in Example 1, and the ignition loss (Ig-loss) thereof was calculated by the same method as that in Example 1. Moreover, the crystalline diameter (Dx) thereof was obtained by the same method as that in Example 1. As a result, the BET specific surface area was 0.58 $m^2/g$. The particle diameters $D_{10}$, $D_{50}$ and $D_{90}$ were 1.0 μm, 1.7 μm and 2.6 μm, respectively. The shrinking percentage thereof (based on TMA) reached 50% at a temperature of 425° C., and the ignition loss (Ig-loss) thereof was 1.21%. The crystalline diameter (Dx) thereof was 235 angstroms.

The obtained spherical silver powder was used for producing a conductive paste and a conductive film by the same methods as those in Example 2. The average thickness and resistance value of the conductive film thus produced were measured by the same methods as those in Example 2, and the volume resistivity thereof was calculated by the same method as that in Example 2. As a result, when the peak temperature during firing was 770° C., the average thickness thereof was 13.6 μm, the resistance value thereof was 0.329 Ω, and the volume resistivity thereof was 2.03 μΩ·cm. When the peak temperature during firing was 720° C., the average thickness thereof was 14.1 μm, the resistance value thereof was 0.330 Ω, and the volume resistivity thereof was 2.12 Ω·cm.

Comparative Example 6

First, 162 g of an industrial ammonia water having a concentration of 28% by weight was added to 3.3 L of an aqueous silver nitrate solution containing 0.13 mol/L of silver ions to form a silver ammine complex solution. The pH of the silver ammine complex solution was adjusted by adding 7.5 g of an aqueous sodium hydroxide solution having a concentration of 20% by weight thereto. While the liquid temperature of the solution was maintained at 28° C., there was added thereto an aqueous solution prepared by diluting 250 g of an aqueous formalin solution having a concentration of 37% by weight serving as a reducing agent with 125 g of pure water, and the solution was sufficiently stirred to obtain a slurry containing silver particles. Then, 0.614 g of an aqueous solution containing 15.5% by weight of stearic acid serving as a surface treatment agent was added to the slurry. After the solution thus obtained was sufficiently stirred, the stirring was stopped to precipitate silver particles, and the obtained solution (or slurry) containing the precipitated silver particles was filtrated. The solid body thus obtained was washed with water. After the washed solid body was dried, it was pulverized to obtain a silver powder.

The silver powder thus obtained was observed at a magnification of 10,000 by means of a scanning electron microscope (SEM). As a result, it was confirmed that the shape of the silver powder was spherical. With respect to the obtained spherical silver powder, the BET specific surface area and particle diameter distribution thereof were measured by the same methods as those in Example 1. In addition, the shrinking percentage thereof based on the thermomechanical analysis (TMA) was measured by the same method as that in Example 1, and the ignition loss (Ig-loss) thereof was calculated by the same method as that in Example 1. Moreover, the crystalline diameter (Dx) thereof was obtained by the same method as that in Example 1. As a result, the BET specific surface area was 0.51 $m^2/g$. The particle diameters $D_{10}$, $D_{50}$ and $D_{90}$ were 1.1 μm, 1.7 μm and 2.6 μm, respectively. The shrinking percentage thereof (based on TMA) reached 50% at a temperature of 463° C., and the ignition loss (Ig-loss) thereof was 0.73%. The crystalline diameter (Dx) thereof was 305 angstroms.

The obtained spherical silver powder was used for producing a conductive paste and a conductive film by the same methods as those in Example 2. The average thickness and resistance value of the conductive film thus produced were measured by the same methods as those in Example 2, and the volume resistivity thereof was calculated by the same method as that in Example 2. As a result, when the peak temperature during firing was 770° C., the average thickness thereof was 13.6 μm, the resistance value thereof was 0.352 Ω, and the volume resistivity thereof was 2.18 μΩ·cm. When the peak temperature during firing was 720° C., the average thickness thereof was 14.0 μm, the resistance value thereof was 0.367 Ω, and the volume resistivity thereof was 2.33 μΩ·cm.

Example 15

First, 172 g of an industrial ammonia water having a concentration of 28% by weight was added to 3.3 L of an aqueous silver nitrate solution containing 0.12 mol/L of silver ions to form a silver ammine complex solution. The pH of the silver ammine complex solution was adjusted by adding 5.3 g of an aqueous sodium hydroxide solution having a concentration of 20% by weight thereto. Then, 5.98 g of an aqueous L-tryptophan solution containing 7% by weight of L-tryptophan (0.84% by weight of L-tryptophan with respect to silver), which was prepared by dissolving L-tryptophan (produced by Wako Pure Chemical Industries, Ltd., molecular weight=204.23, neutral, carbon number=11) in 5.56 g of an aqueous sodium hydroxide solution having a concentration of 2.0% by weight, was added to the pH-adjusted silver ammine complex solution. While the liquid temperature of the solution was maintained at 40° C., there was added thereto an aqueous solution prepared by diluting 241 g of an aqueous formalin solution having a concentration of 37% by weight serving as a reducing agent with 193 g of pure water, and the solution was sufficiently stirred to obtain a slurry containing silver particles. Then, 0.785 g of an aqueous solution containing 13.1% by weight of oleic acid serving as a surface treatment agent was added to the slurry. After the solution thus obtained was sufficiently stirred, the stirring was stopped to precipitate silver particles, and the obtained solution (or slurry) containing the precipitated silver particles was filtrated. The solid body thus obtained was washed with water. After the washed solid body was dried, it was pulverized to obtain a silver powder.

The silver powder thus obtained was observed at a magnification of 10,000 by means of a scanning electron microscope (SEM). As a result, it was confirmed that the shape of the silver powder was spherical. With respect to the obtained spherical silver powder, the BET specific surface area and particle diameter distribution thereof were measured by the same methods as those in Example 1. In addition, the shrinking percentage thereof based on the thermomechanical analysis (TMA) was measured by the same method as that in Example 1, and the ignition loss (Ig-loss) thereof was calculated by the same method as that in Example 1. Moreover, the crystalline diameter (Dx) thereof was obtained by the same method as that in Example 1. As a result, the BET specific surface area was 0.51 $m^2/g$. The particle diameters $D_{10}$, $D_{50}$ and $D_{90}$ were 1.3 μm, 2.4 μm and 3.8 μm, respectively. The shrinking percentage thereof (based on TMA) reached 50% at a temperature of 421° C., and the ignition loss (Ig-loss) thereof was 1.57%. The crystalline diameter (Dx) thereof was 205 angstroms.

The obtained spherical silver powder was used for producing a conductive paste and a conductive film by the same methods as those in Example 2, except that the in-put time in the fast firing IR furnace was 35 seconds. The average thickness and resistance value of the conductive film thus produced were measured by the same methods as those in Example 2, and the volume resistivity thereof was calculated by the same method as that in Example 2. As a result, when the peak temperature during firing was 770° C., the average thickness thereof was 13.3 μm, the resistance value thereof was 0.329 Ω, and the volume resistivity thereof was 1.99 μΩ·cm. When the peak temperature during firing was 720° C., the average thickness thereof was 14.4 μm, the resistance value thereof was 0.338 Ω, and the volume resistivity thereof was 2.22 μΩ·cm.

Comparative Example 7

First, 172 g of an industrial ammonia water having a concentration of 28% by weight was added to 3.3 L of an aqueous silver nitrate solution containing 0.12 mol/L of silver ions to form a silver ammine complex solution. The pH of the silver ammine complex solution was adjusted by adding 6.8 g of an aqueous sodium hydroxide solution having a concentration of 20% by weight thereto. While the liquid temperature of the solution was maintained at 40° C., there was added thereto an aqueous solution prepared by diluting 241 g of an aqueous formalin solution having a concentration of 37% by weight serving as a reducing agent with 193 g of pure water, and the solution was sufficiently stirred to obtain a slurry containing silver particles. Then, 0.785 g of an aqueous solution containing 13.1% by weight of oleic acid serving as a surface treatment agent was added to the slurry. After the solution thus obtained was sufficiently stirred, the stirring was stopped to precipitate silver particles, and the obtained solution (or slurry) containing the precipitated silver particles was filtrated. The solid body thus obtained was washed with water. After the washed solid body was dried, it was pulverized to obtain a silver powder.

The silver powder thus obtained was observed at a magnification of 10,000 by means of a scanning electron microscope (SEM). As a result, it was confirmed that the shape of the silver powder was spherical. With respect to the obtained spherical silver powder, the BET specific surface area and particle diameter distribution thereof were measured by the same methods as those in Example 1. In addition, the shrinking percentage thereof based on the thermomechanical analysis (TMA) was measured by the same method as that in Example 1, and the ignition loss (Ig-loss) thereof was calculated by the same method as that in Example 1. Moreover, the crystalline diameter (Dx) thereof was obtained by the same method as that in Example 1. As a result, the BET specific surface area was 0.39 $m^2/g$. The particle diameters $D_{10}$, $D_{50}$ and $D_{90}$ were 1.5 μm, 2.4 μm and 4.0 μm, respectively. The shrinking percentage thereof (based on TMA) reached 50% at a temperature of 476° C., and the ignition loss (Ig-loss) thereof was 0.53%. The crystalline diameter (Dx) thereof was 335 angstroms.

The obtained spherical silver powder was used for producing a conductive paste and a conductive film by the same methods as those in Example 15. The average thickness and resistance value of the conductive film thus produced were measured by the same methods as those in Example 15, and the volume resistivity thereof was calculated by the same method as that in Example 15. As a result, when the peak temperature during firing was 770° C., the average thickness thereof was 13.2 μm, the resistance value thereof was 0.370 Ω, and the volume resistivity thereof was 2.22 μΩ·cm. When the peak temperature during firing was 720° C., the average thickness thereof was 14.4 μm, the resistance value thereof was 0.375 Ω, and the volume resistivity thereof was 2.46 μΩ·cm.

Example 16

First, 150 g of an industrial ammonia water having a concentration of 28% by weight was added to 3.3 L of an aqueous silver nitrate solution containing 0.12 mol/L of silver ions to form a silver ammine complex solution. The pH of the silver ammine complex solution was adjusted by adding 6.2 g of an aqueous sodium hydroxide solution having a concentration of 20% by weight thereto. Then, 5.98 g of an aqueous L-tryptophan solution containing 7% by weight of L-tryptophan (0.84% by weight of L-tryptophan with respect to silver), which was prepared by dissolving L-tryptophan (produced by Wako Pure Chemical Industries, Ltd., molecular weight=204.23, neutral, carbon number=11) in 5.56 g of an aqueous sodium hydroxide solution having a concentration of 2.0% by weight, was added to the pH-adjusted silver ammine complex solution. While the liquid temperature of the solution was maintained at 20° C., there was added thereto an aqueous solution prepared by diluting 230 g of an aqueous formalin solution having a concentration of 37% by weight serving as a reducing agent with 207 g of pure water, and the solution was sufficiently stirred to obtain a slurry containing silver particles. Then, 0.396 g of an aqueous solution containing 2.0% by weight of benzotriazole serving as a surface treatment agent was added to the slurry. After the solution thus obtained was sufficiently stirred, the stirring was stopped to precipitate silver particles, and the obtained solution (or slurry) containing the precipitated silver particles was filtrated. The solid body thus obtained was washed with water. After the washed solid body was dried, it was pulverized to obtain a silver powder.

The silver powder thus obtained was observed at a magnification of 10,000 by means of a scanning electron microscope (SEM). As a result, it was confirmed that the shape of the silver powder was spherical. With respect to the obtained spherical silver powder, the BET specific surface area and particle diameter distribution thereof were measured by the same methods as those in Example 1. In addition, the shrinking percentage thereof based on the thermomechanical analysis (TMA) was measured by the same method as that in Example 1, and the ignition loss (Ig-loss) thereof was calculated by the same method as that in Example 1. Moreover, the crystalline diameter (Dx) thereof was obtained by the same method as that in Example 1. As a result, the BET specific surface area was 1.05 $m^2/g$. The particle diameters $D_{10}$, $D_{50}$ and $D_{90}$ were 0.6 μm, 1.3 μm and 2.0 μm, respectively. The shrinking percentage thereof (based on TMA) reached 50% at a temperature of 396° C., and the ignition loss (Ig-loss) thereof was 1.67%. The crystalline diameter (Dx) thereof was 170 angstroms.

The obtained spherical silver powder was used for producing a conductive paste and a conductive film by the same methods as those in Example 15, except that 0.39 g of 2,2,4-trimethyl-1,3-pentane diol monoisobutyrate was further added during the preliminary kneading. The average thickness and resistance value of the conductive film thus produced were measured by the same methods as those in Example 15, and the volume resistivity thereof was calculated by the same method as that in Example 15. As a result, when the peak temperature during firing was 770° C., the average thickness thereof was 11.1 μm, the resistance value thereof was 0.391 Ω, and the volume resistivity thereof was 1.98 μΩ·cm. When the peak temperature during firing was 720° C., the average thickness thereof was 11.4 μm, the resistance value thereof was 0.405 Ω, and the volume resistivity thereof was 2.11 μΩ·cm.

Comparative Example 8

First, 150 g of an industrial ammonia water having a concentration of 28% by weight was added to 3.3 L of an aqueous silver nitrate solution containing 0.12 mol/L of silver ions to form a silver ammine complex solution. The pH of the silver ammine complex solution was adjusted by adding 6.8 g of an aqueous sodium hydroxide solution having a concentration of 20% by weight thereto. While the liquid temperature of the solution was maintained at 20° C., there was added thereto an aqueous solution prepared by diluting 230 g of an aqueous formalin solution having a concentration of 37% by weight serving as a reducing agent with 207 g of pure water, and the solution was sufficiently stirred to obtain a slurry containing silver particles. Then, 0.396 g of an aqueous solution containing 2.0% by weight of benzotriazole serving as a surface treatment agent was added to the slurry. After the solution thus obtained was sufficiently stirred, the stirring was stopped to precipitate silver particles, and the obtained solution (or slurry) containing the precipitated silver particles was filtrated. The solid body thus obtained was washed with water. After the washed solid body was dried, it was pulverized to obtain a silver powder.

The silver powder thus obtained was observed at a magnification of 10,000 by means of a scanning electron microscope (SEM). As a result, it was confirmed that the shape of the silver powder was spherical. With respect to the obtained spherical silver powder, the BET specific surface area and particle diameter distribution thereof were measured by the same methods as those in Example 1. In addition, the shrinking percentage thereof based on the thermomechanical analysis (TMA) was measured by the same method as that in Example 1, and the ignition loss (Ig-loss) thereof was calculated by the same method as that in Example 1. Moreover, the crystalline diameter (Dx) thereof was obtained by the same method as that in Example 1. As a result, the BET specific surface area was 0.84 $m^2/g$. The particle diameters $D_{10}$, $D_{50}$ and $D_{90}$ were 0.8 μm, 1.3 μm and 2.0 μm, respectively. The shrinking percentage thereof (based on TMA) reached 50% at a temperature of 453° C., and the ignition loss (Ig-loss) thereof was 0.83%. The crystalline diameter (Dx) thereof was 260 angstroms.

The obtained spherical silver powder was used for producing a conductive paste and a conductive film by the same methods as those in Example 15, except that 0.39 g of 2,2,4-trimethyl-1,3-pentane diol monoisobutyrate was further added during the preliminary kneading. The average thickness and resistance value of the conductive film thus produced were measured by the same methods as those in Example 15, and the volume resistivity thereof was calculated by the same method as that in Example 15. As a result, when the peak temperature during firing was 770° C., the average thickness thereof was 11.1 μm, the resistance value thereof was 0.400 Ω, and the volume resistivity thereof was 2.02 μΩ·cm. When the peak temperature during firing was 720° C., the average thickness thereof was 11.5 μm, the resistance value thereof was 0.419 Ω, and the volume resistivity thereof was 2.19 μΩ·cm.

Figure 2:
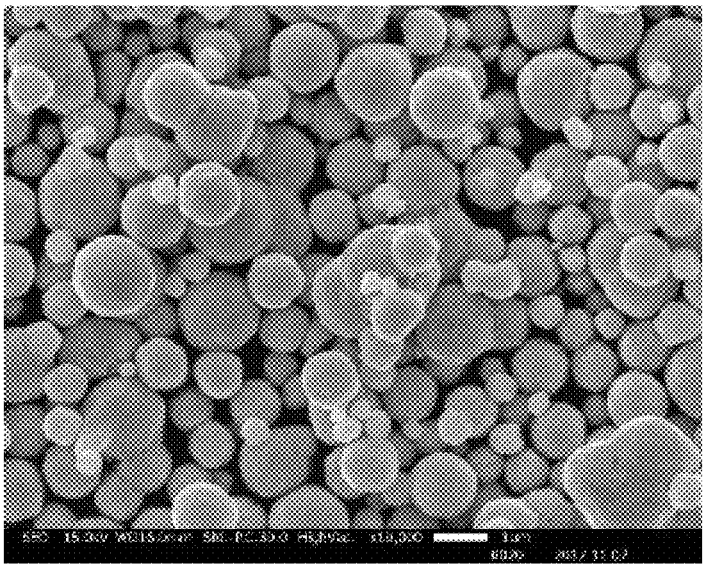
FIG. 2 is an SEM image of a spherical silver powder which is obtained in Example 4.
Figure 3:
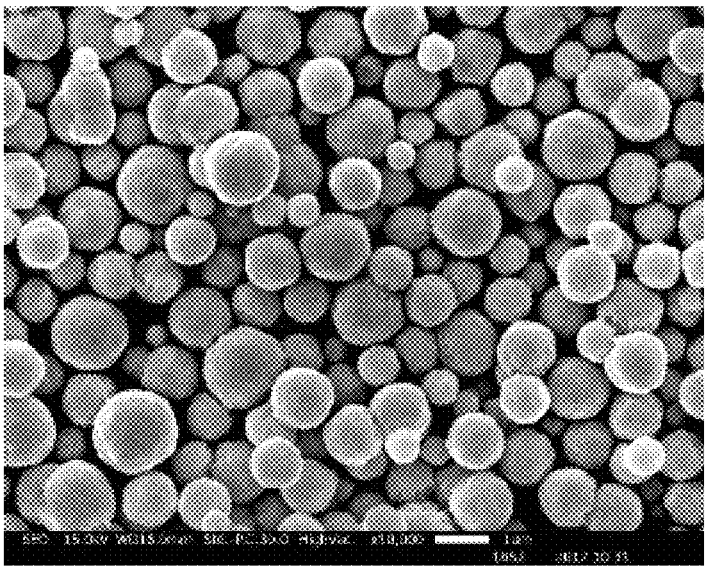
FIG. 3 is an SEM image of a spherical silver powder which is obtained in Example 6.
Figure 4:
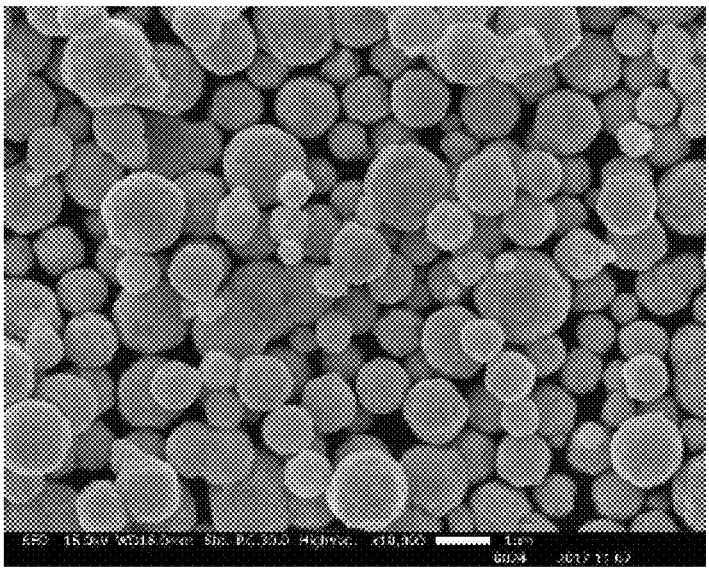
FIG. 4 is an SEM image of a spherical silver powder which is obtained in Example 8.
Figure 5:
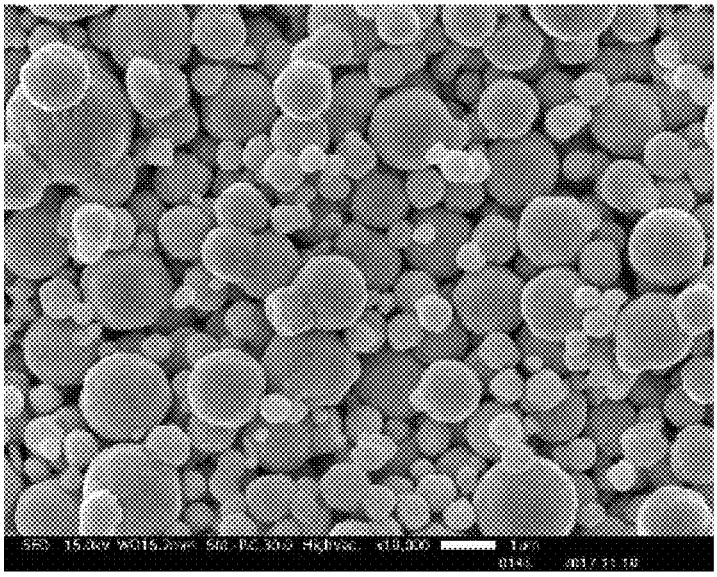
FIG. 5 is an SEM image of a spherical silver powder which is obtained in Example 10.
Figure 6:
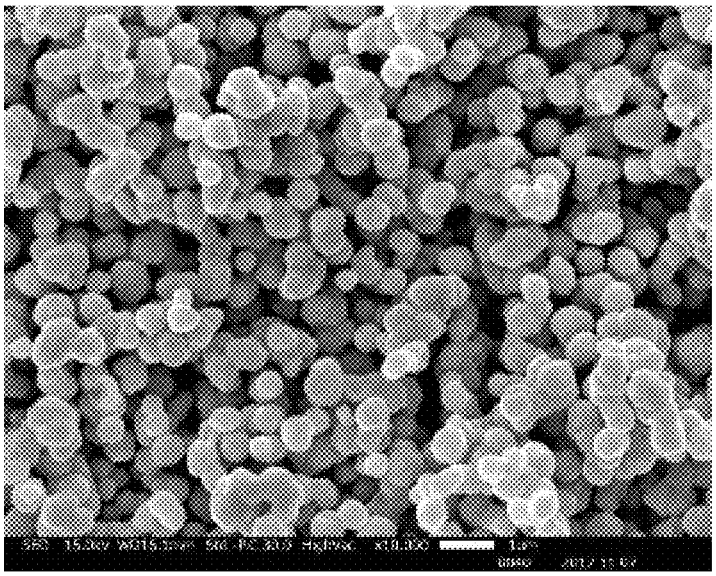
FIG. 6 is an SEM image of a spherical silver powder which is obtained in Example 12.
Figure 7:
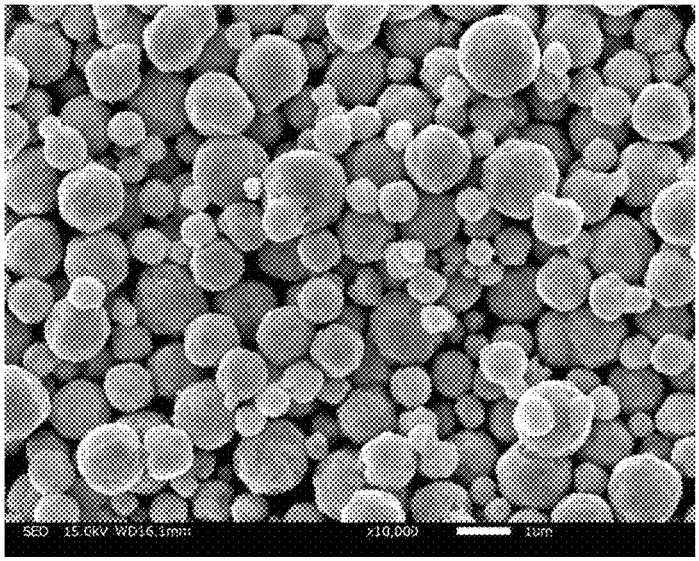
FIG. 7 is an SEM image of a spherical silver powder which is obtained in Comparative Example 2.
Figure 8:
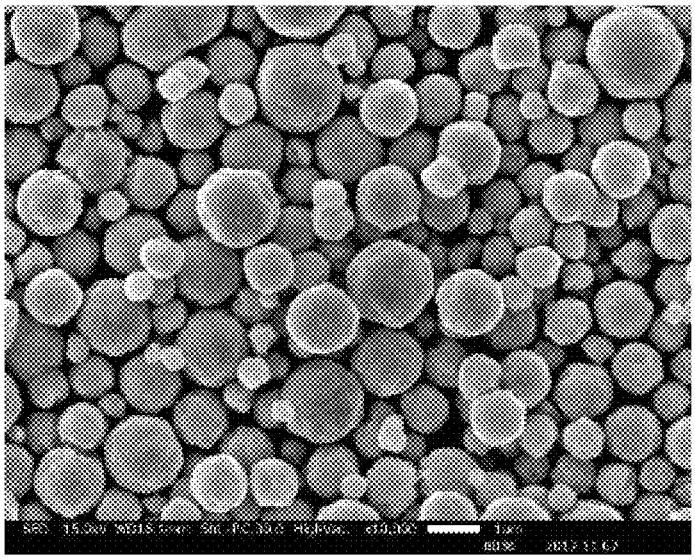
FIG. 8 is an SEM image of a spherical silver powder which is obtained in Comparative Example 4.
Figure 9:
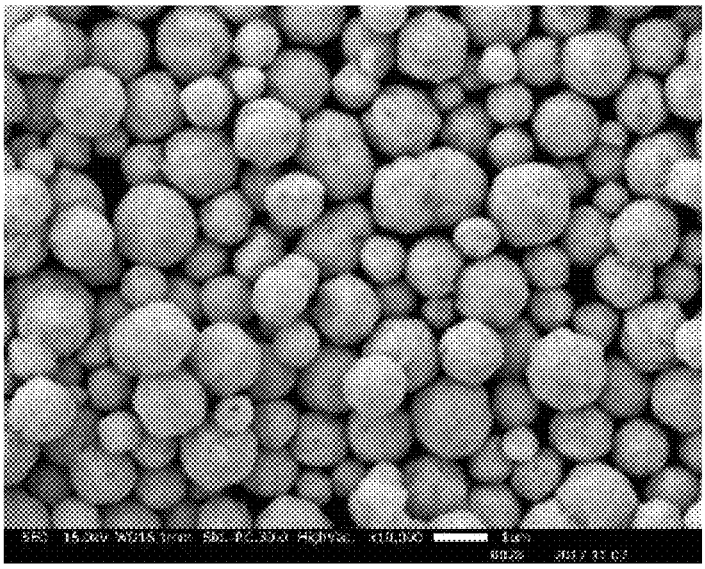
FIG. 9 is an SEM image of a spherical silver powder which is obtained in Comparative Example 5.
Figure 10:
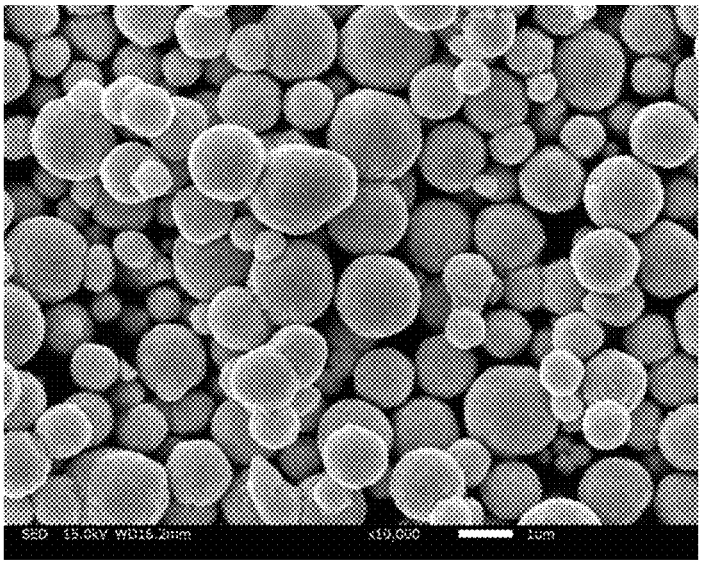
FIG. 10 is an SEM image of a spherical silver powder which is obtained in Example 13.
Figure 11:
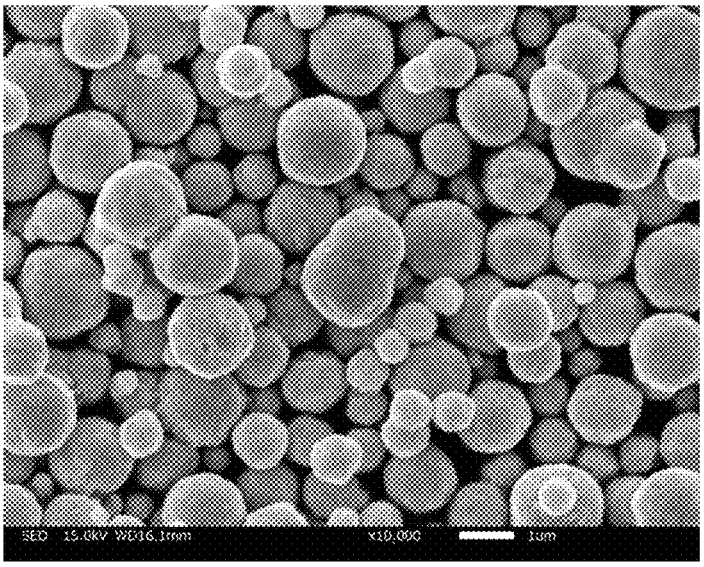
FIG. 11 is an SEM image of a spherical silver powder which is obtained in Example 14.
Figure 12:
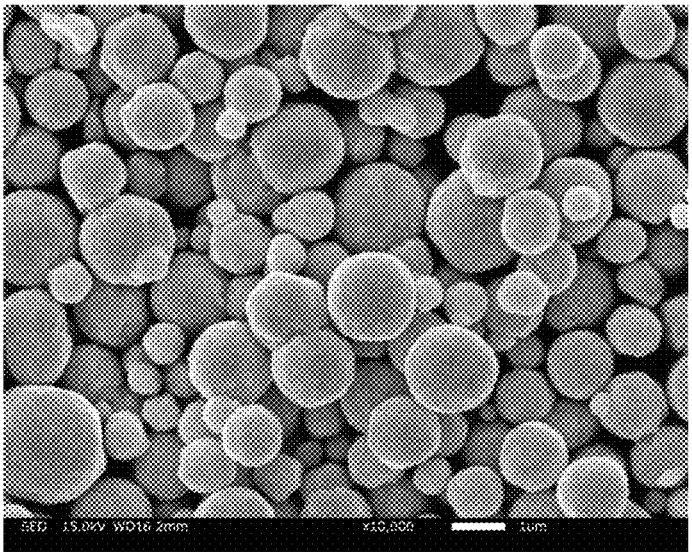
FIG. 12 is an SEM image of a spherical silver powder which is obtained in Example 15.
Figure 13:
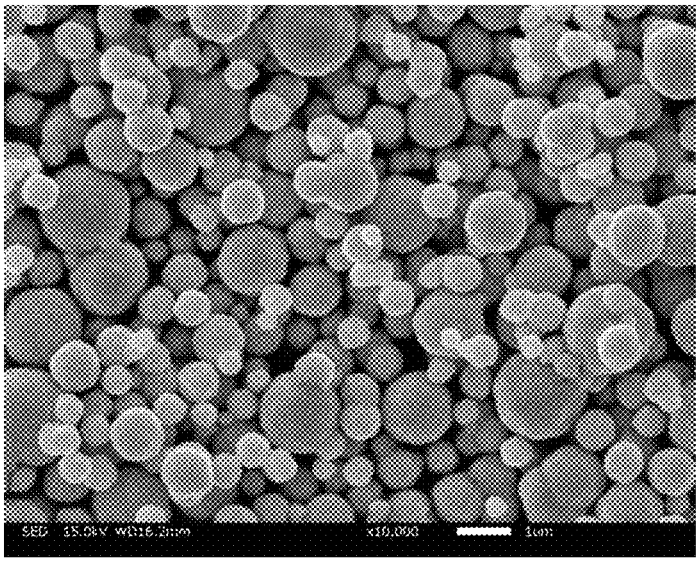
FIG. 13 is an SEM image of a spherical silver powder which is obtained in Example 16.

The characteristics of the spherical silver powders obtained in these examples and comparative examples are shown in Tables 1-3. FIGS. 1-9 show the scanning electron microscope (SEM) images obtained by observing the spherical silver powders, which were obtained in Examples 2, 4, 6, 8, 10 and 12 and Comparative Examples 2, 4 and 5, at a magnification of 10,000 by means of a scanning electron microscope (JSM-IT300LV produced by JEOL Ltd.), and FIGS. 10-13 show the SEM images obtained by observing the spherical silver powders, which were obtained in Examples 13-16, at a magnification of 10,000 by means of the scanning electron microscope (SEM).

TABLE 1

| | Amino Acid | | | |
|---|---|---|---|---|
| | Kind | Carbon Number | Added Amount (wt %) | Surface Treatment Agent |
| Ex. 1 | L-phenylalanine (neutral) | 9 | 0.68 | — |
| Ex. 2 | L-phenylalanine (neutral) | 9 | 0.68 | Stearic acid |
| Ex. 3 | L-tryptophan (neutral) | 11 | 0.84 | — |
| Ex. 4 | L-tryptophan (neutral) | 11 | 0.84 | Stearic acid |
| Ex. 5 | L-tyrosine (neutral) | 9 | 0.75 | — |
| Ex. 6 | L-tyrosine (neutral) | 9 | 0.75 | Stearic acid |
| Ex. 7 | L-proline (neutral) | 5 | 0.47 | — |
| Ex. 8 | L-proline (neutral) | 5 | 0.47 | Stearic acid |
| Ex. 9 | L-arginine (basic) | 6 | 0.72 | — |
| Ex. 10 | L-arginine (basic) | 6 | 0.72 | Stearic acid |
| Ex. 11 | L-histidine (basic) | 6 | 0.64 | — |
| Ex. 12 | L-histidine (basic) | 6 | 0.64 | Stearic acid |
| Ex. 13 | L-tryptophan (neutral) | 11 | 0.84 | Stearic acid |
| Ex. 14 | L-tryptophan (neutral) | 11 | 0.28 | Stearic acid |
| Ex. 15 | L-tryptophan (neutral) | 11 | 0.84 | oleic acid |
| Ex. 16 | L-tryptophan (neutral) | 11 | 0.84 | benzotriazole |
| Comp. 1 | — | — | — | — |
| Comp. 2 | — | — | — | Stearic acid |
| Comp. 3 | L-alanine (neutral) | 3 | 0.37 | — |
| Comp. 4 | L-alanine (neutral) | 3 | 0.37 | Stearic acid |

TABLE 1-continued

| | Amino Acid | | | |
|---|---|---|---|---|
| | Kind | Carbon Number | Added Amount (wt %) | Surface Treatment Agent |
| Comp. 5 | L-phenylalanine (neutral) added later | 9 | 0.68 | Stearic acid |
| Comp. 6 | — | — | — | Stearic acid |
| Comp. 7 | — | — | — | Oleic acid |
| Comp. 8 | — | — | — | benzotriazole |

TABLE 2

| | BET | Particle Size Distribution (μm) | | | Amino Acid in Particles | TMA | Ig-loss | $D_X$ |
|---|---|---|---|---|---|---|---|---|
| | ($m^2/g$) | $D_{10}$ | $D_{50}$ | $D_{90}$ | (wt %) | (° C.) | (%) | (Å) |
| Ex. 1 | 0.55 | 1.2 | 2.1 | 3.9 | 0.0008 | 439 | 1.18 | 225 |
| Ex. 2 | 0.72 | 0.9 | 1.4 | 2.1 | 0.0018 | 402 | 1.14 | 270 |
| Ex. 3 | 1.22 | 0.7 | 1.4 | 2.5 | 0.54 | 380 | 1.46 | 175 |
| Ex. 4 | 0.70 | 1.0 | 1.7 | 2.7 | 0.132 | 388 | 1.53 | 190 |
| Ex. 5 | 0.99 | 0.8 | 1.6 | 2.9 | 0.0020 | 417 | 1.35 | 190 |
| Ex. 6 | 0.60 | 1.0 | 1.7 | 2.8 | 0.0002 | 381 | 1.29 | 210 |
| Ex. 7 | 0.81 | 0.8 | 1.7 | 3.0 | 0.00003 | 457 | 0.85 | 250 |
| Ex. 8 | 0.53 | 1.0 | 1.6 | 2.5 | 0.0009 | 446 | 0.88 | 270 |
| Ex. 9 | 1.05 | 0.8 | 1.6 | 2.8 | 0.00004 | 436 | 1.20 | 220 |
| Ex. 10 | 0.62 | 0.9 | 1.7 | 2.7 | 0.0001 | 415 | 1.63 | 220 |
| Ex. 11 | 1.47 | 0.8 | 1.5 | 2.6 | 0.00035 | 420 | 1.12 | 195 |
| Ex. 12 | 1.55 | 0.9 | 1.7 | 2.7 | 0.00023 | 390 | 1.25 | 205 |
| Ex. 13 | 0.62 | 1.1 | 1.9 | 3.1 | — | 401 | 1.51 | 190 |
| Ex. 14 | 0.58 | 1.0 | 1.7 | 2.6 | — | 425 | 1.21 | 235 |
| Ex. 15 | 0.51 | 1.3 | 2.4 | 3.8 | — | 421 | 1.57 | 205 |
| Ex. 16 | 1.05 | 0.6 | 1.3 | 2.0 | — | 396 | 1.67 | 170 |
| Comp. 1 | 0.77 | 0.8 | 1.5 | 2.3 | — | 462 | 0.65 | 305 |
| Comp. 2 | 0.55 | 0.9 | 1.4 | 2.1 | — | 461 | 0.88 | 290 |
| Comp. 3 | 0.66 | 1.1 | 2.0 | 3.7 | 0.00002 | 477 | 0.78 | 265 |
| Comp. 4 | 0.60 | 0.9 | 1.5 | 2.3 | — | 441 | 0.95 | 255 |
| Comp. 5 | 0.55 | 1.0 | 1.4 | 2.1 | 0 | 461 | 0.87 | 285 |
| Comp. 6 | 0.51 | 1.1 | 1.7 | 2.6 | — | 463 | 0.73 | 305 |
| Comp. 7 | 0.39 | 1.5 | 2.4 | 4.0 | — | 476 | 0.53 | 335 |
| Comp. 8 | 0.84 | 0.8 | 1.3 | 2.0 | — | 453 | 0.83 | 260 |

TABLE 3

| | Peak Temp. 770° C. | | Peak Temp. 720° C. | |
|---|---|---|---|---|
| | Thickness of Film (μm) | Volume Resistivity (μΩ · cm) | Thickness of Film (μm) | Volume Resistivity (μΩ · cm) |
| Ex. 2 | 15.4 | 2.01 | 15.5 | 2.12 |
| Ex. 4 | 15.2 | 2.11 | 14.7 | 2.03 |
| Ex. 6 | 15.6 | 2.17 | 15.8 | 2.29 |
| Ex. 8 | 14.9 | 2.17 | 15.1 | 2.26 |
| Ex. 10 | 13.9 | 2.09 | 14.1 | 2.09 |
| Ex. 12 | 13.7 | 2.17 | 14.2 | 2.32 |
| Ex. 13 | 13.7 | 2.05 | 14.0 | 2.14 |
| Ex. 14 | 13.6 | 2.03 | 14.1 | 2.12 |
| Ex. 15 | 13.3 | 1.99 | 14.4 | 2.22 |
| Ex. 16 | 11.1 | 1.98 | 11.4 | 2.11 |
| Comp. 2 | 15.5 | 2.55 | 15.2 | 2.65 |
| Comp. 4 | 15.2 | 2.47 | 15.6 | 2.62 |
| Comp. 5 | 14.5 | 2.35 | 14.2 | 2.41 |
| Comp. 6 | 13.6 | 2.18 | 14.0 | 2.33 |
| Comp. 7 | 13.2 | 2.22 | 14.4 | 2.46 |
| Comp. 8 | 11.7 | 2.02 | 11.5 | 2.19 |

INDUSTRIAL APPLICABILITY

The spherical silver powder according to the present invention can be used for preparing a conductive paste as a spherical silver powder capable of being sintered at a lower temperature. The conductive paste containing this spherical silver powder can be printed on a substrate by a screen printing or the like to be used as an electromagnetic shielding material or the like in addition to electrodes and circuits of electronic parts, such as solar cells, chip parts and touch panels.

The invention claimed is:

1. A spherical silver powder comprising:

spherical silver particles; and an amino acid which has a carbon number of not less than 5 and which is neutral or basic, the amino acid being contained in each of the spherical silver particles, the amino acid being at least one selected from the group consisting of proline, tyrosine, tryptophan, phenylalanine, arginine and anthranilic acid, wherein said spherical silver powder has an average particle diameter $D_{50}$ of 0.2 to 5 μm based on a laser diffraction method, and wherein said spherical silver powder has a BET specific surface area of 0.1 to 3 $m^2/g$.

2. A spherical silver powder as set forth in claim 1, wherein the amount of said amino acid contained in each of said spherical silver particles is in the range of from 0.00001% by weight to 1% by weight.

3. A spherical silver powder as set forth in claim 1, wherein said spherical silver powder has a BET specific surface area of 0.2 to 2 $m^2/g$.

4. A spherical silver powder as set forth in claim 1, wherein said average particle diameter $D_{50}$ is 0.5 to 5 μm.

5. A conductive paste comprising:

a spherical silver powder as set forth in claim 1; and an organic vehicle.

* * * * *